United States Patent [19]

Boussemart et al.

[11] Patent Number: 4,753,452

[45] **Date of Patent: * Jun. 28, 1988**

[54] SAFETY SKI BINDING

[75] Inventors: Jean P. Boussemart, Choisy; Rene Bressand, Saint Jorioz; Roger Pascal, Annecy-Le-Vieux, all of France

[73] Assignee: Salomon S.A., Annecy, France

[ * ] Notice: The portion of the term of this patent subsequent to Nov. 19, 2002 has been disclaimed.

[21] Appl. No.: 476,124

[22] Filed: Mar. 17, 1983

[30] Foreign Application Priority Data

Mar. 17, 1982 [FR] France ..... 82 04947

[51] Int. Cl.[4] ..... A63C 9/084

[52] U.S. Cl. ..... 280/628; 280/629; 280/631; 280/634

[58] Field of Search ..... 280/628, 629, 631, 632, 280/634

[56] References Cited

U.S. PATENT DOCUMENTS

| | | | |
|---|---|---|---|
| 3,563,561 | 2/1971 | Mottet | 280/628 |
| 4,358,132 | 11/1982 | Beyl | 280/628 |
| 4,402,525 | 9/1983 | Salomon | 280/628 |
| 4,457,533 | 7/1984 | Salomon | 280/628 |

FOREIGN PATENT DOCUMENTS

| | | | |
|---|---|---|---|
| 1578761 | 6/1971 | Fed. Rep. of Germany . | |
| 2405514 | 8/1975 | Fed. Rep. of Germany . | |
| 2637871 | 8/1976 | Fed. Rep. of Germany | 280/628 |
| 3104633 | 12/1981 | Fed. Rep. of Germany . | |
| 3308754 | 9/1983 | Fed. Rep. of Germany | 280/628 |
| 1594026 | 7/1970 | France . | |
| 2031883 | 11/1970 | France . | |
| 7019251 | 1/1972 | France . | |
| 2138694 | 1/1973 | France . | |
| 7601102 | 8/1977 | France . | |
| 2418656 | 9/1979 | France . | |
| 7807805 | 10/1979 | France . | |
| 7808342 | 10/1979 | France . | |
| 2424037 | 11/1979 | France . | |
| 2480130 | 10/1981 | France | 280/628 |
| 8008557 | 10/1981 | France . | |

*Primary Examiner*—John J. Love
*Assistant Examiner*—Eric Culbreth
*Attorney, Agent, or Firm*—Sandler & Greenblum

[57] ABSTRACT

A ski binding adapted to pivot both laterally and vertically. The binding includes a support attached to the ski and an assembly adapted to pivot therearound. The assembly includes a jaw, a pivoting element and an elastic system which biases the pivoting element and support into contact with each other. The pivoting element and the support form a lateral pivoting system having two projections and complementary grooves, each of which form a line of support around which the pivoting element and assembly may laterally pivot. The elastic system in one embodiment contacts the rear of the support. In another embodiment the elastic system contacts the rear of a rocker pivoting around the pivoting element, and contacting the rear of the support. Both the rear of the rocker and the rear of the support comprise a downwardly and rearwardly extending release incline and a downwardly and forwardly extending opening incline. The elastic system is compressed when it pivots vertically along the release incline, so as to bias the assembly toward its centered boot retaining position. The elastic system is decompressed when it moves onto the opening incline, thereby holding the assembly in an open position after the boot is released, for the reattachment of the boot. The release incline on the support may be shaped in the form of a trapezoid in one embodiment. This shape causes a reduction in the lateral release retention moment (which resists the lateral pivoting of the assembly) when the assembly undergoes a lateral and vertical pivoting simultaneously, as compared to lateral pivoting alone. In a second embodiment, this effect can be achieved by the proper choice of the position of the axis around which the rocker pivots.

61 Claims, 14 Drawing Sheets

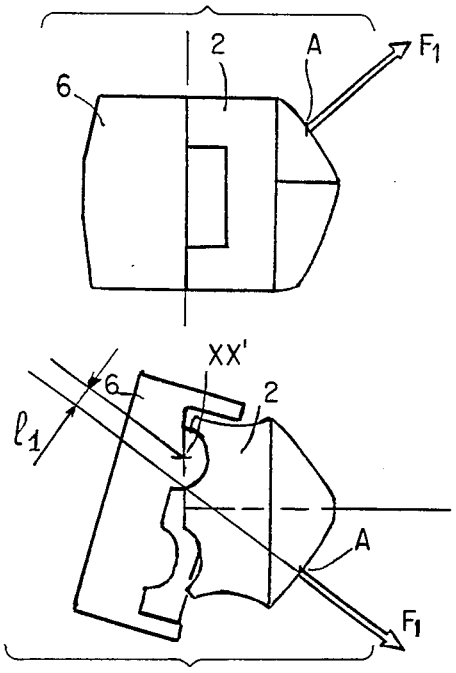
FIG. 7.
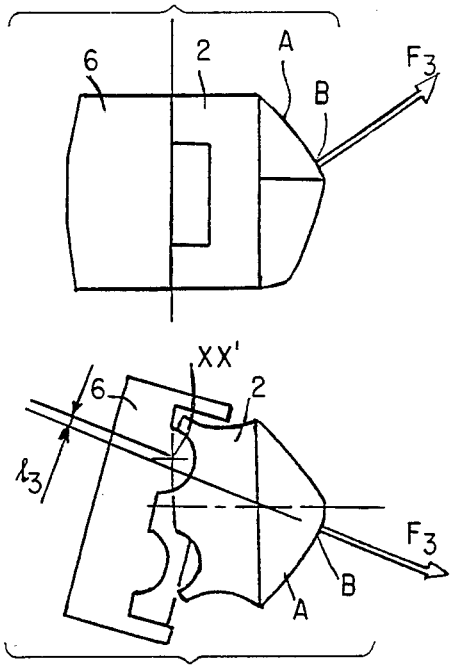
FIG. 8.
FIG. 9.
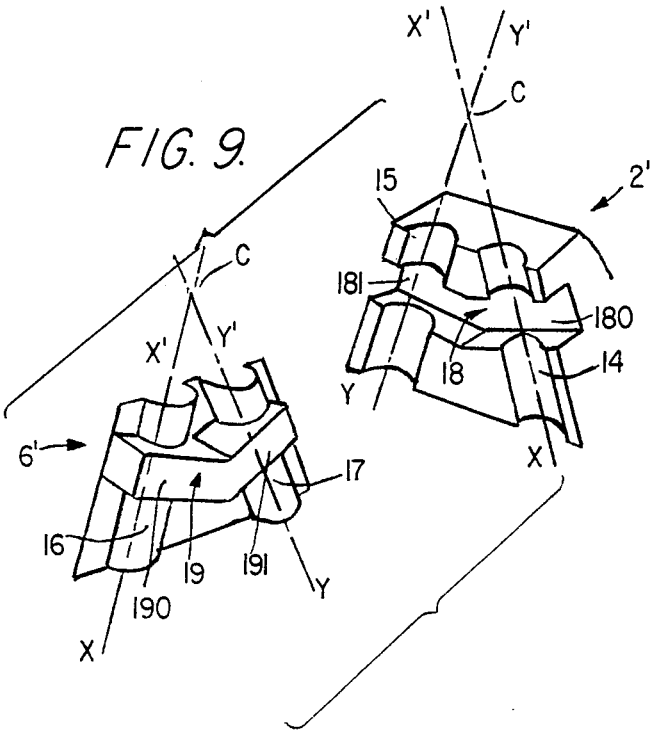
FIG. 10.
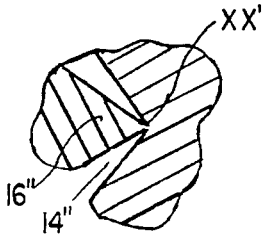

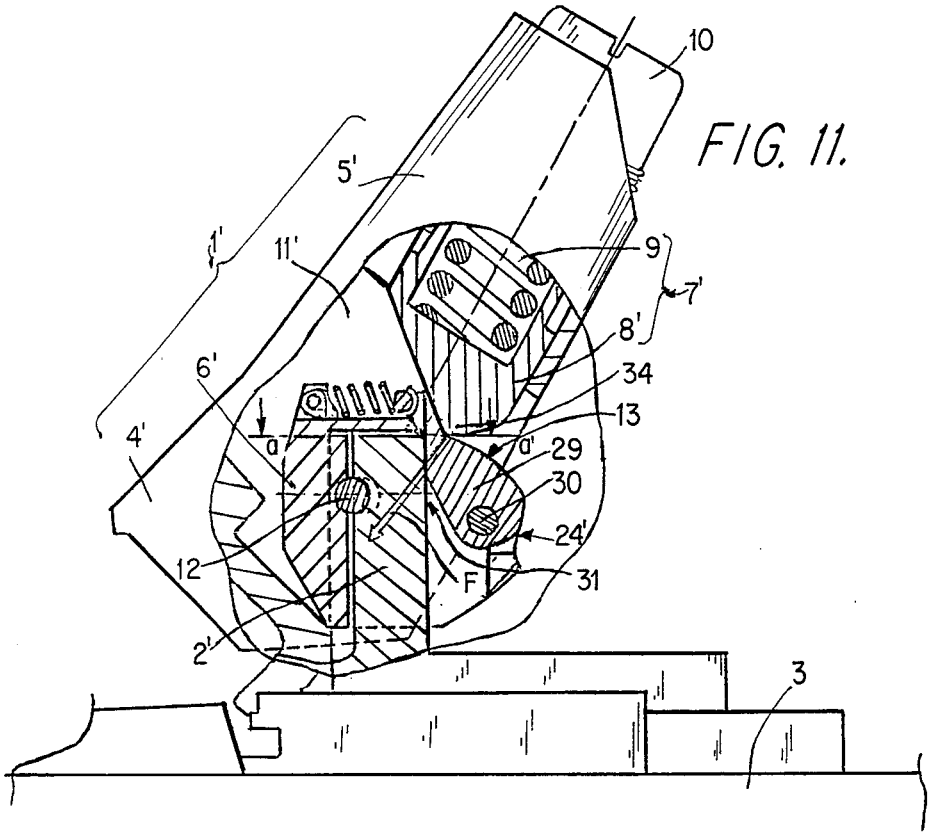
FIG. 11.
FIG. 12.
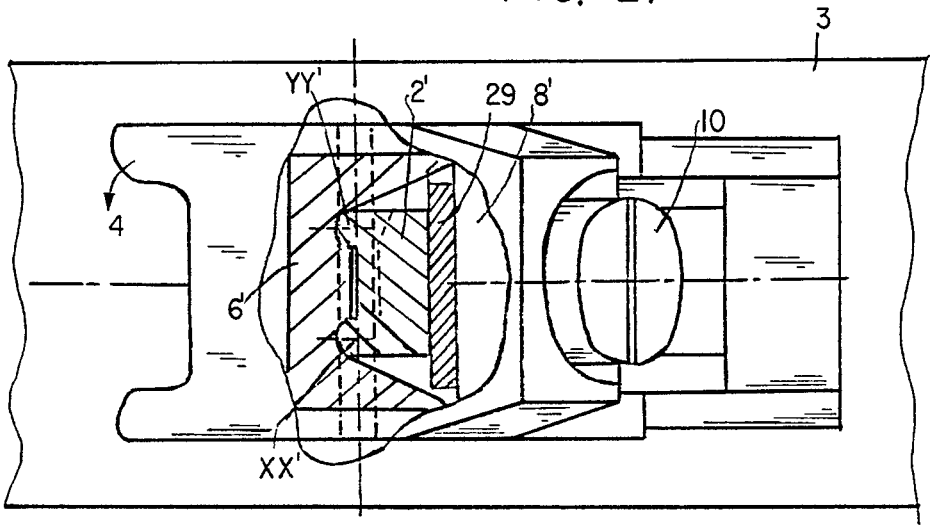

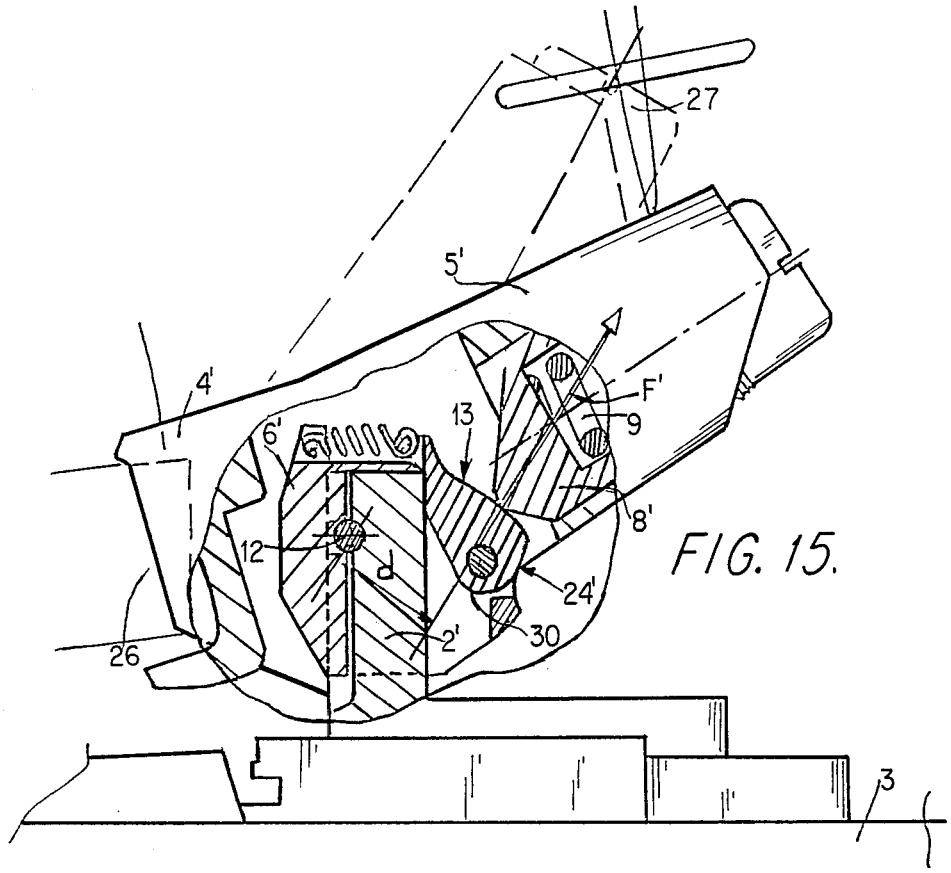
FIG. 15.
FIG. 16.
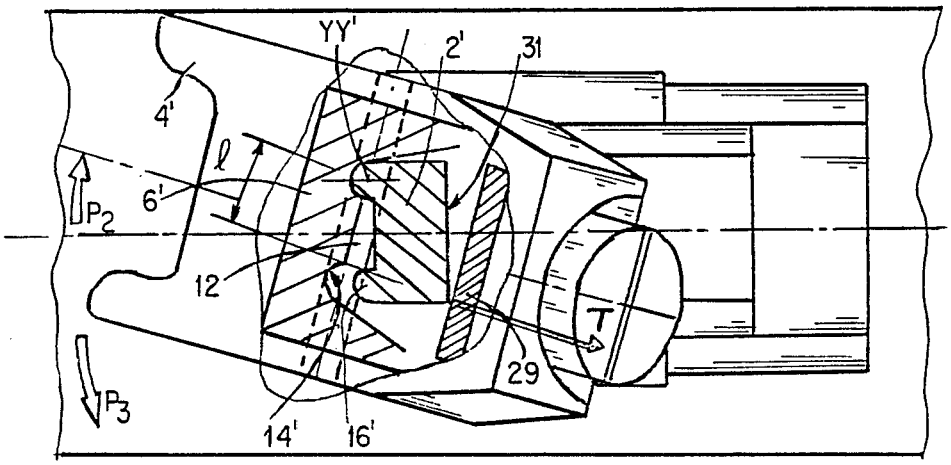

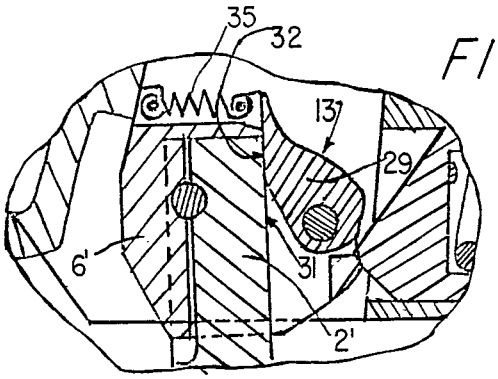
FIG. 17.
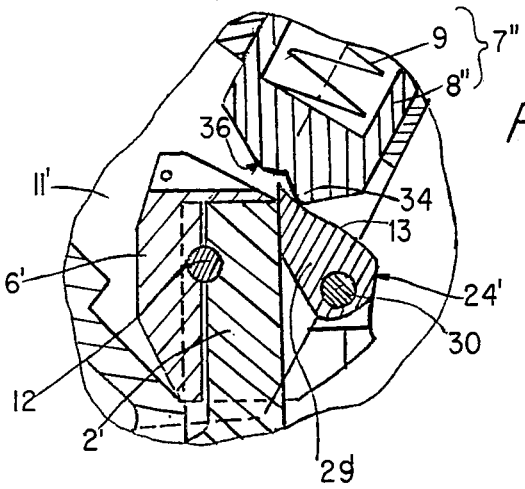
FIG. 18.
FIG. 19.
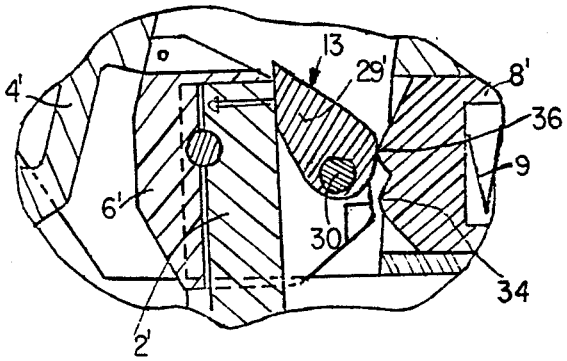
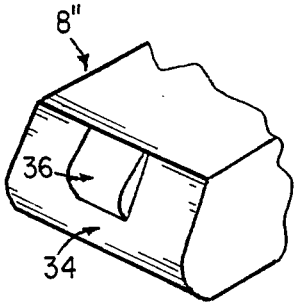
FIG. 20.

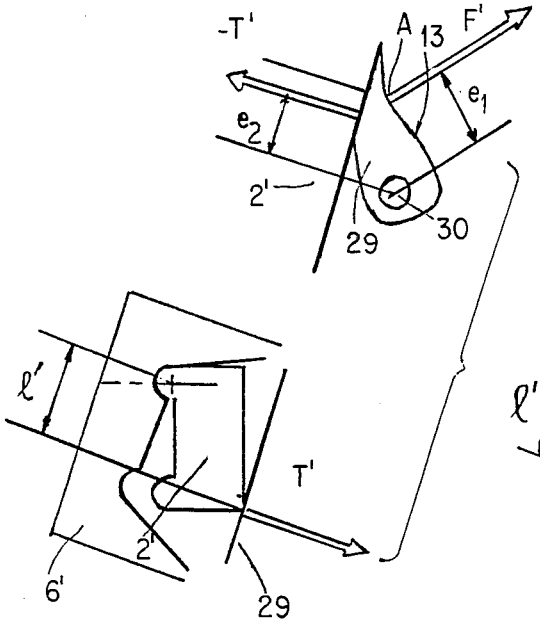
FIG. 21.
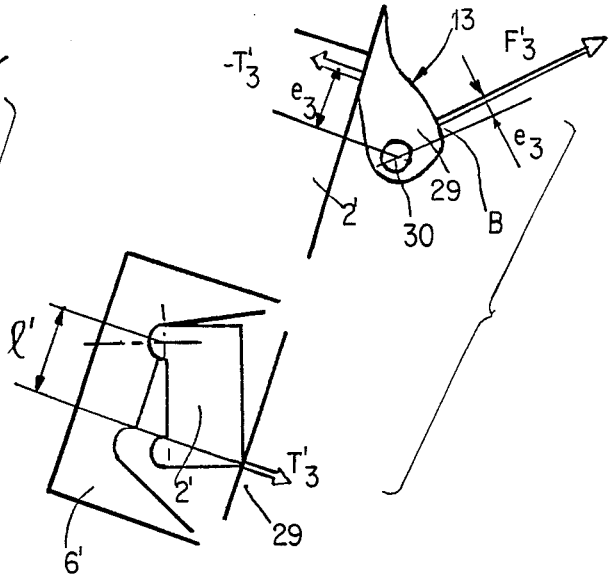
FIG. 22.
FIG. 24.
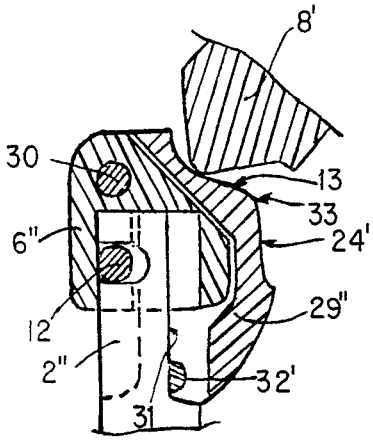
FIG. 23.
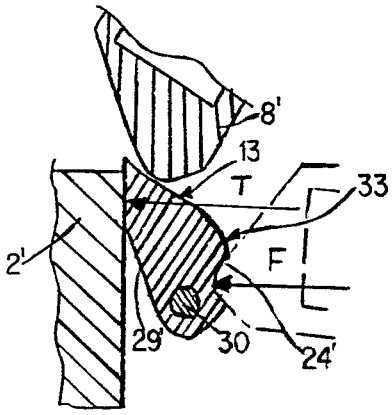

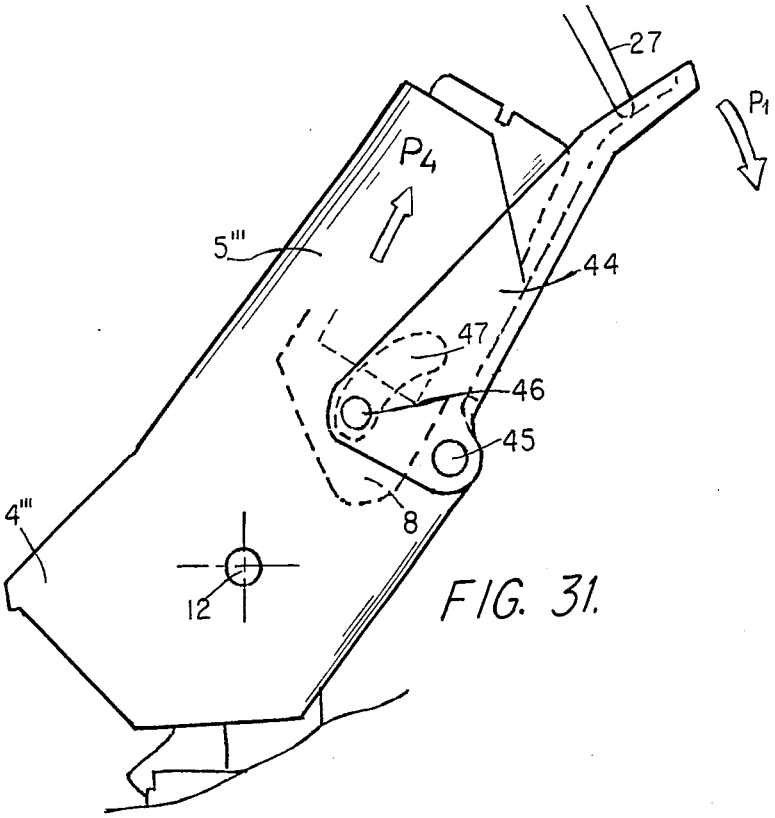
FIG. 31.
FIG. 32.
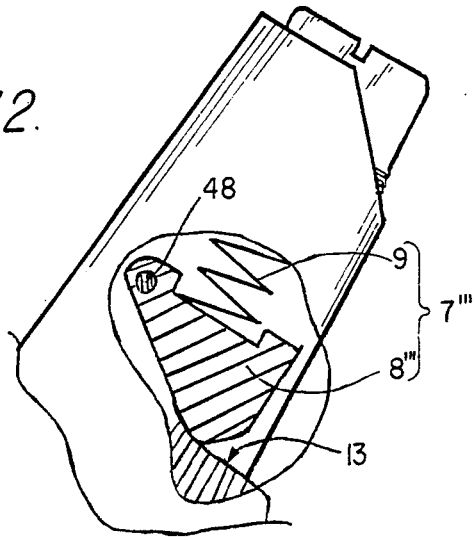

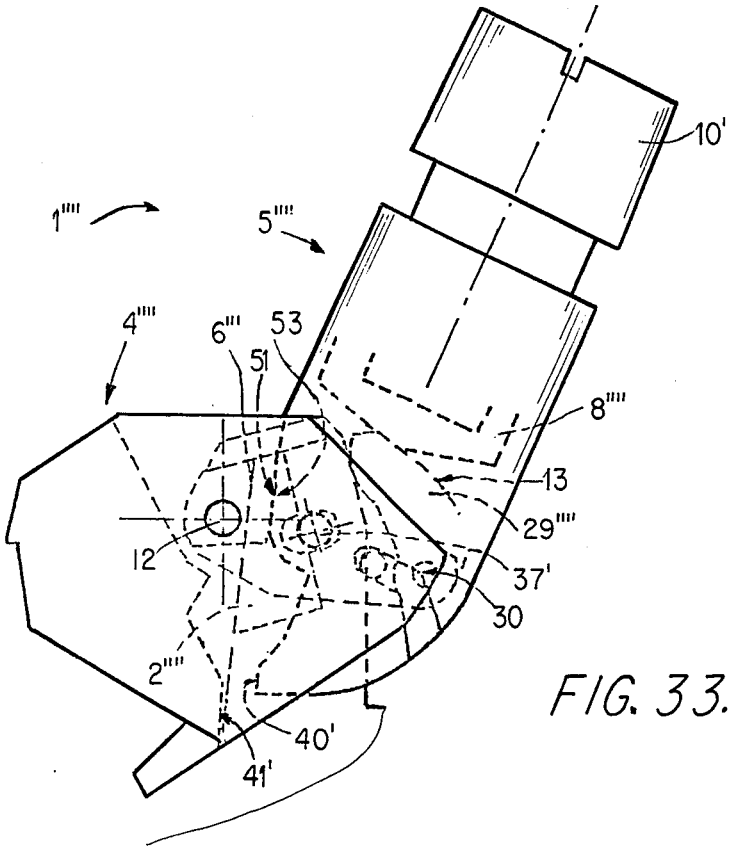
FIG. 33.
FIG. 34.
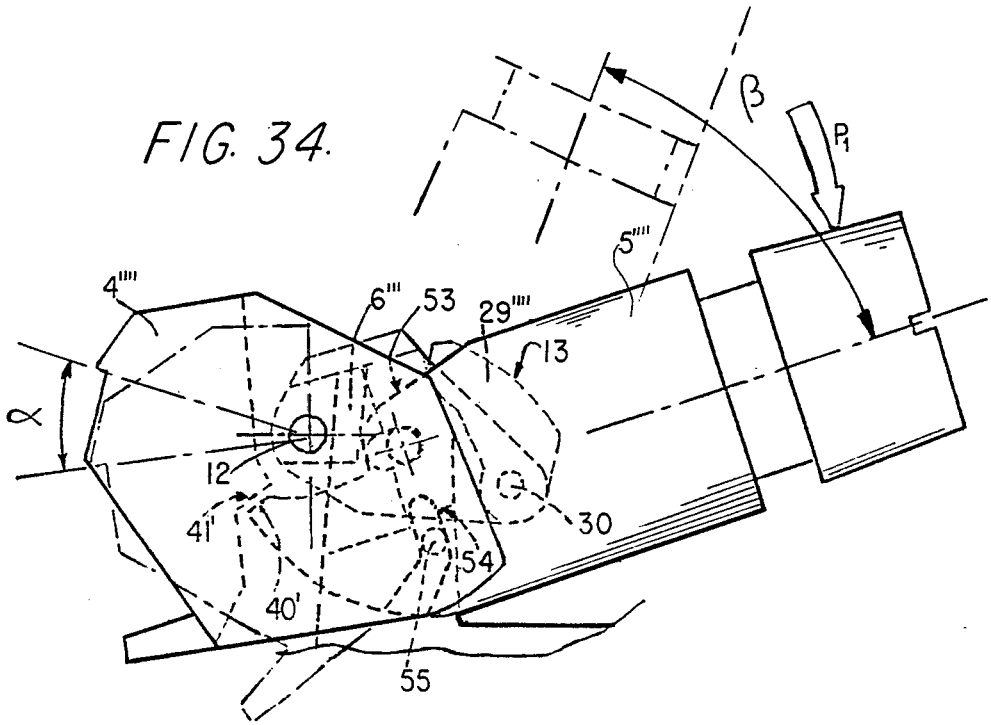

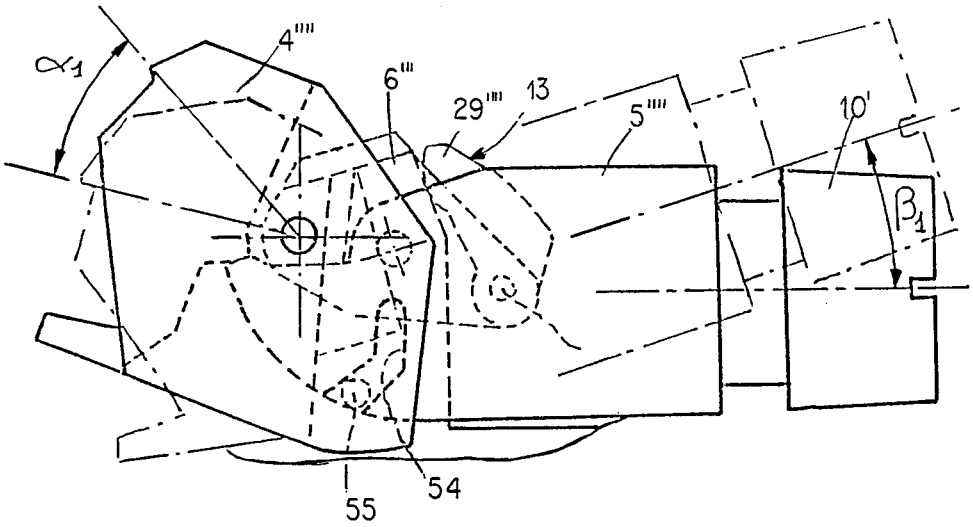
FIG. 35.
FIG. 36.
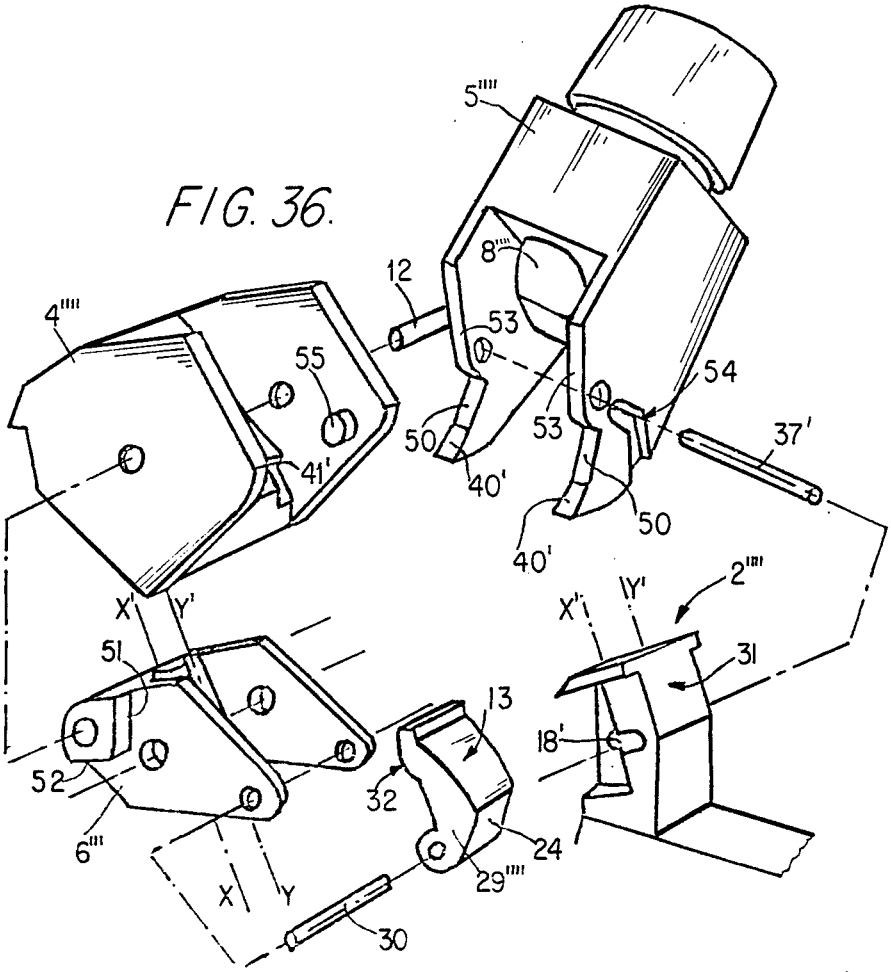

SAFETY SKI BINDING

REFERENCE TO RELATED COPENDING APPLICATION

Application Ser. No. 328,144 filed Dec. 7, 1981 is presently copending and relates to a pivotable binding in name of applicant.

FIELD OF THE INVENTION

The present invention relates to a safety binding adapted to releasably hold a boot on a ski. More particularly, the invention relates to a heel type binding adapted to hold the back end of the boot and to permit the boot to pivot both vertically and laterally.

BACKGROUND OF THE INVENTION

Bindings having a jaw that is adapted to hold a boot and move between a boot retention position and a release position are well known. Generally, this movement of the jaw is a vertical pivoting movement around an axis transverse to the longitudinal axis of the ski and/or binding, and occurs against the action of an elastic system. The elastic system usually comprises a mobile member biased by a spring against a release incline on a support attached to the ski. The binding described in French Pat. No. 76.01102 is an example of such a binding. However, such a binding has serious disadvantages because it only releases the boot when there is an upward stress on the ski. Thus, lateral release of the boot is not possible.

In addition, there are numerous bindings which provide only for lateral pivoting and release of the boot and these can be dangerous to the leg in the event of vertical stresses. For_example, the binding described in French Pat. Nos. 78.07805 and 78.08342 only release the boot in the event of lateral stresses; no vertical release is provided for.

To solve this problem, bindings have been proposed having jaws that can pivot both vertically and laterally. The prior art includes many diverse bindings that can pivot laterally and vertically. Two such examples are French Pat. Nos. 70.19251 and 80.08557. The binding described in French Pat. No. 70.19251 has a jaw mounted on a universal joint and biased to a centered retention positio by an elastic locking system. French Pat. No. 80.08557 shows a jaw which laterally pivots around a vertical axis located on the longitudinal plane of symmetry of the ski. These bindings, however, still have serious disadvantages. Specifically, in these bindings the lateral release of the boot is not satisfactory and the relationship between the value of the vertical release forces and moments and the value of the lateral release forces and moments are not correct.

There is, therefore, a need for a binding that can pivot both laterally and vertically so that the lateral release of the boot is satisfactory, and so that the relationship between the vertical release retention forces and lateral release retention forces is correct.

SUMMARY OF THE INVENTION

It is thus an object of the present invention to provide a binding that can pivot both laterally and vertically while providing a satisfactory lateral release of the boot.

It is another object of the present invention to provide a binding wherein the relationship between the vertical and lateral release forces and moments are correct for a satisfactory release of the boot.

They and other objects of the invention are achieved by a multidirectional safety binding that is particularly simple and reliable. It comprises a support attached to the ski, and an assembly. The assembly comprises a jaw, a pivoting element, and an elastic means. The elastic means biases the support and the pivoting element into contact with each other. In addition, the assembly is adapted to pivot vertically and laterally against the bias of the elastic means. The elastic means biases the binding to a centered retention position to retain the boot. Furthermore, the lateral pivoting of the assembly is performed about either of two lines of support located symmetrically on either side of the longitudinal plane of the ski.

The assembly further includes a body attached to the jaw and extending rearwardly and upwardly therefrom. The elastic system is housed in this body.

The jaw may be journalled on the pivoting element so as to be adapted to be pivoted vertically around an axis transverse to the longitudinal axis of the binding. Furthermore, the pivoting element is adapted to pivot laterally around either of the two lines of support against the bias of the elastic system.

In one embodiment the support element includes an incline adapted to cooperate with the elastic system for producing a release retention moment resisting the vertical and lateral pivoting of the binding away from its centered retention position. Another embodiment places this incline on a rocker journalled on the pivoting element. This incline causes the lateral release retention moment to be reduced when the binding pivots laterally and vertically, as compared to the valve of the lateral release retention moment when the binding pivots only laterally. In the embodiment wherein the incline is on the support this effect occurs when the incline has a particular shape—e.g., trapezoidal. In the other embodiment wherein the incline is on a rocker, this effect occurs because the axis around which the rocker pivots causes the length of the lever arm to be reduced, when there is simultaneous lateral and vertical pivoting.

The present invention has other advantages. First, this reduction in the lateral release retention moment is accomplished without any slippage or play occurring between the elements of the binding. Second, the contact between the piston and the incline when the assembly pivots laterally as always occurs along a line of contact therebetween. Third, the ratio between the lateral release retention moment and the vertical release retention moment can be easily varied for satisfactory release of the boot by changing the shape of the incline or the lever arm of these moments by changing the axis around which the rocker pivots.

In another embodiment, the support has a rear portion and the elastic means contacts the rear portion of the support. The support also has a front portoin which the pivoting element contacts. The front portion of the support and the pivoting element comprise a lateral pivoting system which comprises two projections and two complementary grooves. Each line of support around which the assembly pivots laterally is defined by the cooperation between one of the projections and one of the complementary grooves. The lines of support may be parallel to each other or may converge at a point above the ski. In one embodiment, the front portion of the support comprises two projections, and the pivoting element comprises the two complementary grooves. In another embodiment, the front portion of the support comprises the two complementary grooves, and the pivoting element comprises the two projections.

The front portion of the support further includes a vertical retention groove having beveled ends, and the pivoting element further includes a vertical retention projection adapted to engage the vertical retention groove. The rear portion of the support comprises a release incline extending rearwardly and downwardly from the front portion of the support. The support also includes an opening incline extending downwardly and forwardly from the release incline.

The elastic means is adapted to pivot vertically and laterally. The support further comprises a compressing means for compressing the elastic means when the elastic means pivots vertically away from a centered boot retaining position. The compression means comprises a release incline extending downwardly and rearwardly from the front portion of the support.

The assembly further includes a body attached to the jaw wherein the elastic system is housed in the body and the jaw is in an open position when the boot is released. The support further comprises a decompressing means for decompressing the elastic means after the elastic means has been compressed by the compressing means and the boot has been released from the jaw. The decompressing means holds the jaw in its open position after the boot is released. The decompressing means comprises an opening incline extending downwardly and forwardly from the release incline.

The rear portion of the support comprises a release incline in the shape of a trapezoid whose two lateral edges converge downward. The interaction of the rear portion of the support and the elastic system produces a lateral release retention moment at a given lateral position of the assembly, which opposes the lateral pivoting of the assembly. The support further includes a reduction means for reducing this lateral release retention moment when the assembly pivots laterally and vertically as compared to when the assembly pivots laterally. The reduction means comprises a release incline in the shape of a trapezoid whose two lateral edges converge downward.

In one embodiment, the pivoting element comprises two projections and further includes two vertical retaining projections, the longitudinal axes of each of the two retaining projections being perpendicular to a different support line. The support further includes two complementary grooves and two complementary vertical retaining grooves, the longitudinal axes of each of the two retention grooves being perpendicular to a different one of the support lines. The grooves and projections may have a cross-section that is in the shape of at least part of a circle or may have a triangular cross-section. In addition, the assembly may further include a body which is integral with the jaw, wherein the elastic means is housed in the body.

In another embodiment, the pivoting element further includes a rocker journalled on the pivoting element so that the elastic means is adapted to contact the rocker. The support has a front portion and a rear portion and the rocker has a front portion. The pivoting element contacts the front portion of the support and the front portion of the rocker is adapted to contact the rear portion of the support. The front portion of the support and the pivoting element comprise a lateral pivoting system. The lateral pivoting system comprises two projections and two complementary grooves such that each line of support is defined by the engagement between one of the projections and one of the complementary grooves. These lines of support may be parallel to each other or converge at a point above the ski. The front portion of the support comprises two projections and the pivoting element comprises two complementary grooves. In another embodiment, the pivoting element may comprise two projections and the front portion of the support may comprise two complementary grooves.

In addition the binding may include a vertical retention means for retaining the vertical position of the pivoting means in relation to the support.

The rocker has a rear portion adapted to contact the elastic means. The rear portion of the rocker comprises a release incline extending downwardly and rearwardly from the front portion of the rocker. The elastic means is adapted to pivot vertically and the rocker further comprises a compressive means for compressing the elastic means when the elastic means pivots vertically away from a centered boot retaining position. The compressive means may be a release incline extending rearwardly and downwardly from the front portion of the rocker. The rocker may further include a release nose on the end of the release incline. When the elastic means contacts this nose, the boot is released.

The pivoting element may further include a decompressive means for decompressing the elastic means. It is so positioned that the elastic means contacts the opening incline when pivoting vertically passed the release nose. The decompressive means is an opening incline extending downwardly and forwardly from the front portion of the pivoting element.

The assembly may further include a locking means for locking the assembly in a centered boot retaining position when the boot is attached to the jaw when the assembly is in an open position. In one embodiment, the locking means comprises a spring for biasing the rocker into contact with the support. In another embodiment, the locking means comprises a projection on the elastic system. The projection biases the rocker against the support when the elastic means contacts the opening incline. In another embodiment, the locking means comprises an axis pin attaching the rocker to the pivoting element and around which the rocker pivots. The pin is so positioned that the elastic means biases the rocker against the support when the assembly is in its open position.

The interaction of the rocker and the elastic means produces a lateral release retention moment at a given lateral position of the assembly which opposes the lateral pivoting of the assembly. This moment is reduced by the rocker which includes a reduction means for reducing the lateral release retention moment at a given lateral position when the assembly pivots laterally land vertically, as compared to when the assembly pivots laterally. The reduction means may include a release incline extending rearwardly and downwardly from the front portion of the rocker.

In addition, in one embodiment the incline is positioned above a horizontal plane passing through the axis around which the rocker pivots, and in another embodiment the incline is positioned below a horizontal plane passing through the axis around which the rocker pivots.

In another embodiment, the assembly includes a body housing the elastic means, such that the jaw is integral with the body. A further embodiment shows the body to be journalled on the jaw around an axis transverse to the longitudinal axis of the binding.

In still another embodiment, the body includes a top stop and a bottom stop, and the jaw includes a top stop and a bottom stop. The stops are so positioned that when the assembly is in its centered boot retaining position the bottom stops of the body and the jaw are spaced apart to permit the vertical pivoting of the body with respect to the jaw toward the open position of the binding. The top stops are so positioned that they contact each other when the assembly is in its centered boot retaining position. In addition, the rocker has a projection thereon for mating with a recess in the support in another embodiment.

In another embodiment, the lateral release system includes two pairs of projections and two pairs of grooves, each pair being symmetrically located on either side of the longitudinal plane of symmetry of the binding.

In still another embodiment, the elastic means includes a piston and a spring. In addition, the assembly further includes a body housing the elastic means, and a lever means journalled on the body for retracting the piston. In still a further embodiment, the elastic means includes a mobile member and a spring and the assembly further includes a body which houses the elastic means. In this embodiment, the mobile member is a lever journalled on the body.

In still another embodiment, the body is journalled on the pivoting element.

In still another embodiment, the body includes an incline, and the jaw comprises at least one projection. The projection of the jaw and the incline of the body are so positioned that the projections engage the incline to pivot the jaw upward when the body is rotated in one direction away from the centered boot retaining position.

The body includes at least one bottom stop and the jaw includes at least one stop. The bottom stop of the body and the stop of the jaw are so positioned as to contact each other after the projection contacts the incline as the assembly pivots away from the centered boot retaining position.

The body further includes at least one lower stop and the pivoting element includes at least one bottom stop. The lower stop of the body and the bottom stop of the pivoting element are so positioned so that they contact each other and prevent further upward pivoting of the assembly when, at some point after assembly has pivoted upward to an open position where the boot is released. The angle through which the body pivots before the bottom stop of the body contacts the stop of the jaw is greater than the angle through which the jaw pivots. In addition, after the bottom stop of the body contacts the stop of the jaw as the assembly pivots, the angle through which the jaw pivots is at least as great as the angle through which the body pivots.

BRIEF DESCRIPTION OF THE DRAWINGS

The invention will now be described by way of non-limiting example, the various embodiments of the invention illustrated in the annexed drawings in which:

FIGS. 1–8 illustrates a first embodiment of the invention, FIGS. 11–24, 28 and 29 illustrate a second embodiment, FIGS. 25–27 illustrate a third embodiment and FIGS. 30–35 illustrate alternate embodiments.

FIG. 1 is a longitudinal cross-sectional lateral view of the binding securing the boot.

FIG. 2 is a partial cross-sectional top view of the binding securing the boot.

FIG. 3 is an exploded perspective view showing a variety of binding elements, including the jaw, the body, the pivoting element and the support element.

FIG. 4 is a perspective view illustrating the rear side of the pivoting element and of the support element.

FIG. 5 is a partial longitudinal cross-sectional lateral view of the binding showing the binding in the course of either a vertical safety release or a voluntary vertical release.

FIG. 6 is a partial cross-sectional top view, similar to FIG. 2, showing the binding in the course of a lateral release.

FIGS. 7 and 8 are schematic views of the pivoting element and support element, showing how the lateral release retention moment is reduced when lateral and vertical pivoting occur simultaneously.

FIG. 9 is a perspective view illustrating an alternative embodiment of the support lines formed by the cooperation between the pivoting element and the support element.

FIG. 10 is a schematic view showing an alternative embodiment on the support lines.

FIG. 11 illustrates a longitudinal cross-sectional lateral view of an alternative embodiment of the binding securing the boot.

FIG. 12 is a partial cross-sectional top view along line aa' in FIG. 1.

FIG. 13 is an exploded perspective view illustrating certain elements of the binding.

FIG. 14 is a perspective view of the back of the pivoting element.

FIG. 15 is a partial longitudinal cross-sectional lateral view of the binding showing the binding in the course of either a vertical safety release or a voluntary vertical release.

FIG. 16 is a partial cross-sectional top view, similar to FIG. 6, showing the binding in the course of lateral release.

FIG. 17 illustrates a cross-sectional view of the locking system of the binding in the release position.

FIG. 18 illustrates a cross-sectional view of the locking system in the lock position for skiing.

FIG. 19 illustrates a cross-sectional view of the locking system with the binding in its release position.

FIG. 20 is a perspective view of the corresponding piston used in FIG. 19.

FIGS. 21 and 22 illustrate schematic views of the support and rocking element showing how the lateral release retention moment is reduced when lateral and vertical pivoting occur simultaneously in the embodiment shown in FIGS. 11–17.

FIGS. 23 and 24 illustrate alternative embodiments of the cooperation between the elastic system, support and pivot.

FIGS. 25–27 show an alternative embodiment in which the body is journalled on the jaw.

FIGS. 28–30 show alternative embodiments of the cooperation of the rocker, support and pivot.

FIG. 31 illustrates another embodiment of the release, having a lever for facilitating the removal of the boot.

FIG. 32 illustrates an alternative embodiment of the elastic system.

FIGS. 33–36 illustrate an alternative embodiment of the binding, wherein the body is journalled on the pivot.

FIG. 33 is a partial cross-sectional side view of an alternative embodiment of the binding in a boot retention position.

FIG. 34 illustrates a partial cross-sectional side view the binding in the course of of a voluntary vertical release of the boot.

FIG. 35 illustrates a partial cross-sectional side view of an alternative embodiment of the binding, in its release position.

FIG. 36 is an exploded perspective view of various constitutive elements of the binding of FIGS. 33-35.

DETAILED DESCRIPTION OF THE PREFERRED EMBODIMENTS

Figure 1:
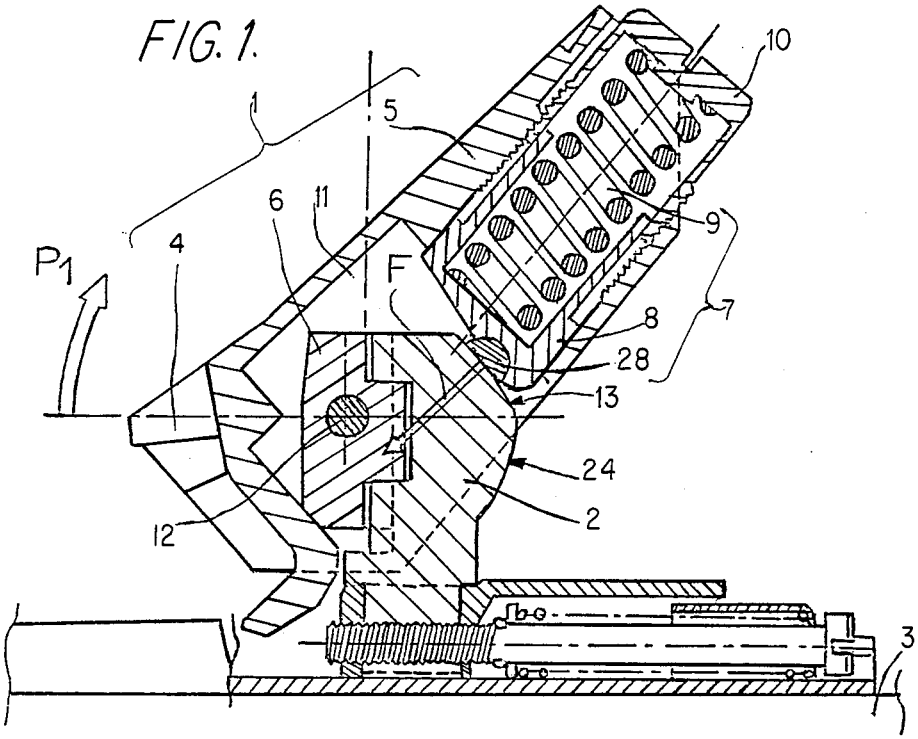

In the various embodiments of the invention discussed below, identical elements have the same reference number while different elements which serve the same function are given the same reference number, but one or more apostrophe's have been added (e.g., 2', 2'', 2''' etc . . . ), after the reference number.

In addition, it should be noted that although the embodiments discussed hereinbelow refer to heel bindings, it is within the scope of the present invention to incorporate the present invention in toe bindings.

The embodiment according to the present invention illustrated in FIGS. 1-10 shows a binding having an assembly 1 which is adapted to move with respect to a support element or support 2 attached to ski 3. Assembly 1 comprises a jaw 4 attached to a body 5 and a pivoting element or pivot 6. In the binding shown in FIGS. 1-10 body 5 is one piece and is integral with jaw 4. However, other variations are envisioned and are illustrated in FIGS. 25-27 and 33-36, which will be discussed below.

Body 5 extends rearwardly and upwardly from jaw 4 and serves as a release lever to release the boot from the ski. Body 5 includes an elastic system 7 therein comprising a mobile member or piston 8 biased by a spring 9 which rests on an adjustment plug 10. Adjustment plug 10 adjusts the tension of spring 9 against piston 8. To the rear of jaw 4 is a housing 11 into which support element 2 extends and within which a pivoting element 6 is located. Pivoting element 6 is laterally fitted in housing 11 by an axis pin 12 so that jaw 4 is journalled on pivoting element 6 and pivots around a transverse and horizontal axis transverse to the longitudinal axis of the binding and ski and passing through axis pin 12.

Thus jaw 4 and assembly 1 are adapted to pivot vertically around said axis pin 12 in the direction $P_1$ shown in FIG. 1. Any vertical pivoting performed by jaw 4 is opposed by elastic system 7. Elastic system 7 exerts a force F called the vertical release retention force and a moment called the vertical release retention moment on a vertical release incline 13 located on the back or rear portion of support element 2 to retain jaw 4 and assembly 1 in the centered retaining or rest position shown in FIGS. 1 and 2.

Assembly 1 is also adapted to pivot laterally, around either one of two lines of support symmetrically located on either side of the longitudinal plane of symmetry of the ski and/or binding. This is accomplished by the lateral pivoting of pivoting element 6 as follows. Pivoting element 6 is adapted to contact or engage support 2. Contact between these two elements is guaranteed by elastic system 7 which biases these elements into contact with one another. Between them, support 2 and pivot 6 form a lateral pivoting system having two lines of support XX' or YY', symmetrically located on either side of the longitudinal plane of symmetry of the ski and/or binding, around which pivot 6 can laterally pivot, against the bias of elastic system 7. This bias or force exerted by elastic system 7 to resist the lateral pivoting of assembly 1 is called the lateral release retention force. The torque or moment created by the interaction of elastic system 7 and support 2 to resist lateral pivoting is called the lateral release retention moment.

To form these support lines, projections are made on one of either support 2 or pivot 6 and complimentary grooves are formed on the other element. In the embodiment shown in FIGS. 1-10, and specifically in FIG. 3 given by way of non-limiting example, grooves 14 and 15 are formed on the front side or portion of support element 2 and the projections 16 and 17 are formed on the back side or portion of the pivoting element 6. The cooperation of groove 14 with projection 16 defines support line XX' and the cooperation of groove 15 with projection 17 defines support line YY'.

An additional groove and projection are formed on support 2 and pivot 6, and cooperate so as to vertically retain pivot 6 in relation to support element 2. In the embodiment shown in FIG. 3 support 2 comprises a vertical retention groove 18 in which a vertical retention projection 19 of pivoting element 6 is adapted to engage or rest. The longitudinal axis of groove 18 and projection 19 are perpendicular to support lines XX' and YY'. The retention of pivot 6 in the vertical direction in support 2 is guaranteed by cooperation between edge 20 of projection 19 and the edge 21 of groove 18. Thus groove 18 is complementary to projection 19. In addition groove 18 is laterally beveled by the diverging sections 22 and 23 so as to permit the lateral pivoting of projection 19 in relation to the support element.

In the embodiment shown in FIGS. 1-10, elastic system 7 biases support 2 and pivot 6 into contact with each other by using spring 9 to bias piston 8 against the back portion or surface of the support element 2. As seen in FIG. 3, the rear or back portion of support 2 comprises a vertical release incline 13 and an opening incline 24 extending downwardly and forwardly therefrom. When pivot 6 pivots vertically in the direction $P_1$ in FIG. 1 around axis pin 12, piston 8 first travels downwardly along incline 13 so as to release the boot (thus the name vertical release incline for element 13). During this movement incline 13 compresses piston 8 against spring 7. Thus incline 13 functions as a compressing element. As piston 8 continues to move downwardly over the back of support 2, it passes nose 99, at which point the boot is released from jaw 4, and piston 8 then travels onto opening incline 24, which permits elastic system 7 to decompress, thereby guaranteeing that the jaw stays in the open position after release. Thus incline 24 functions as a decompressing element. The compressive effect of incline 13 and the decompressive effect of incline 24 occurs because incline 13 extends rearwardly and downwardly from the front portion of support 2 as one views support 2 from a point thereabove, and incline 24 extends downwardly and forwardly (or toward support 2 when viewed from above support 2) from said release incline.

Release incline 13 comprises a curved surface in the shape of a trapezoid and has two lateral edges 25 and 26 converging downward. This shape causes a reduction in the lateral release retention moment when assembly 1 pivots laterally and vertically at the same time as will be explained below. This reduction in the lateral release retention force is necessary for satisfactory lateral release of the boot. It is illustrated in FIGS. 7 and 8.

Figure 2:
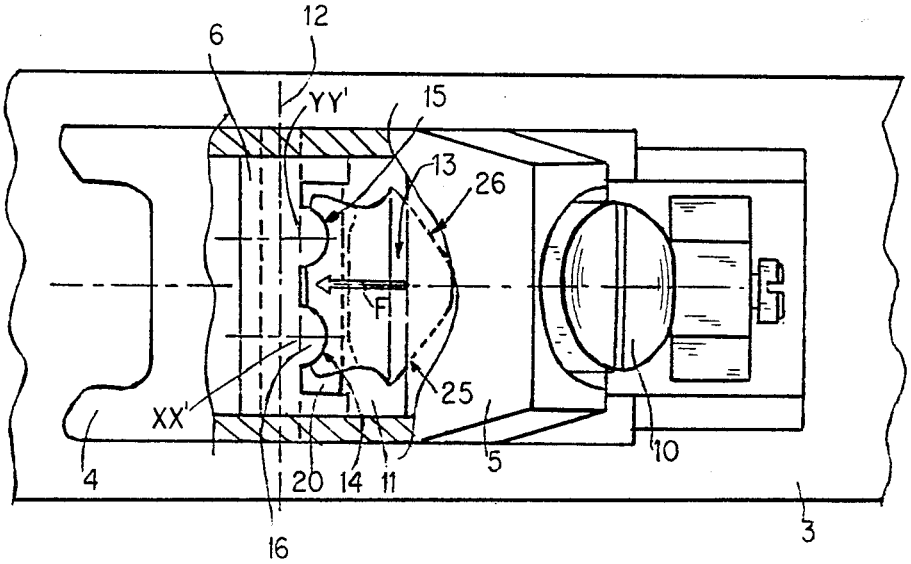
Figure 3:
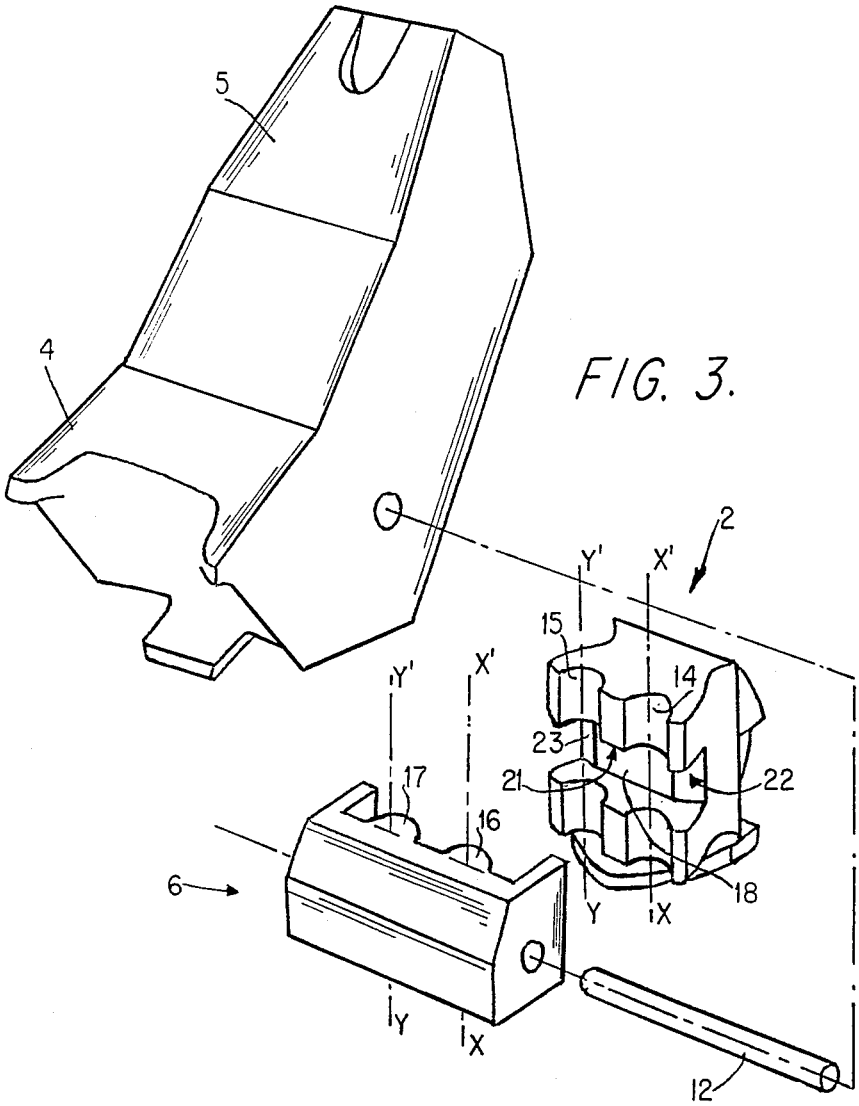
Figure 4:
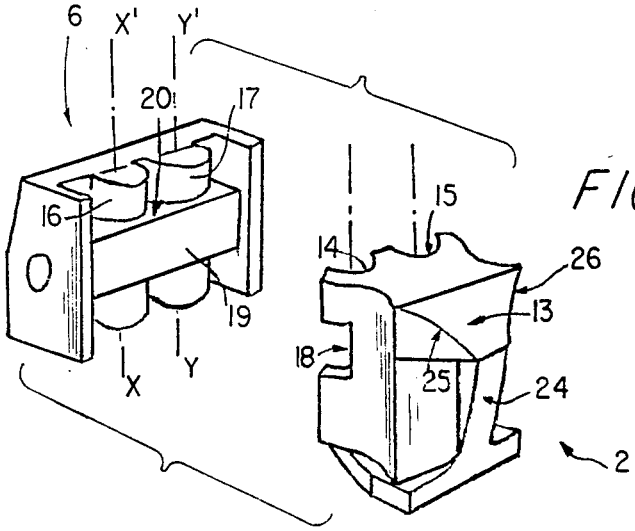
Figure 5:
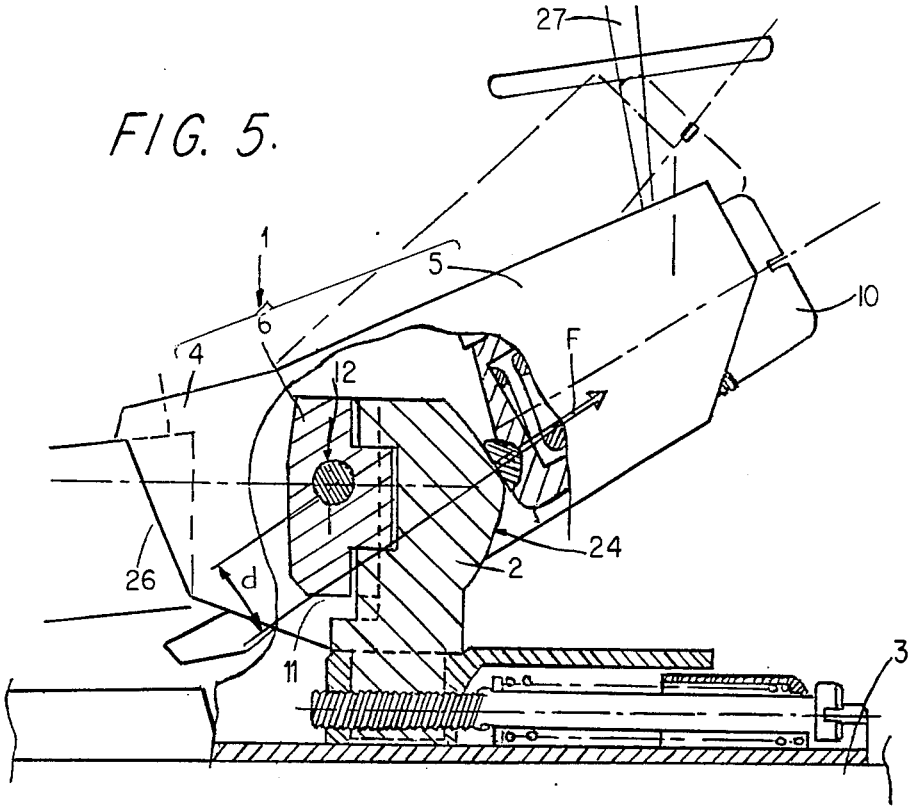

FIGS. 1 and 2 show the binding in a centered boot retention position. The force of support element 2 on elastic system 7 and thus on movable assembly 1 is the force $F_1$. Force $F_1$ holds a part of jaw 4 in a vertical boot retention position and guarantees that pivoting element 6 will contact support element 2. FIG. 5 shows the binding in its open position where the boot is released from the binding due to a vertical pivoting of assembly 1, either because of a vertical safety release by the action of the heel of the boot against the binding during skiing, or during a voluntary release of the binding by means of, for example, rod 27 on the upper end of body 5. The release of the boot due to a vertical pivoting of assembly is a function of $F_1$ multiplied by d. d is the lever arm or perpendicular distance from a line in the direction of $F_1$, and axis pin 12.

Figure 6:
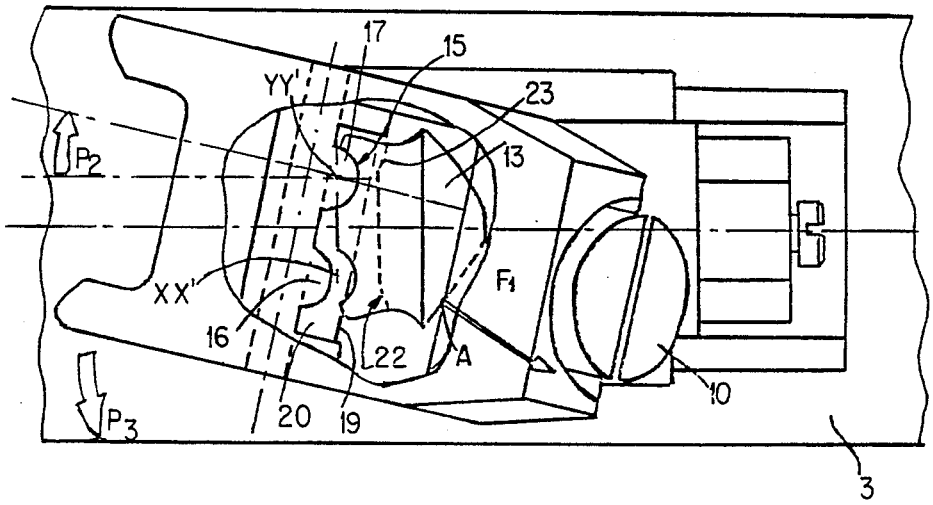
Figure 13:
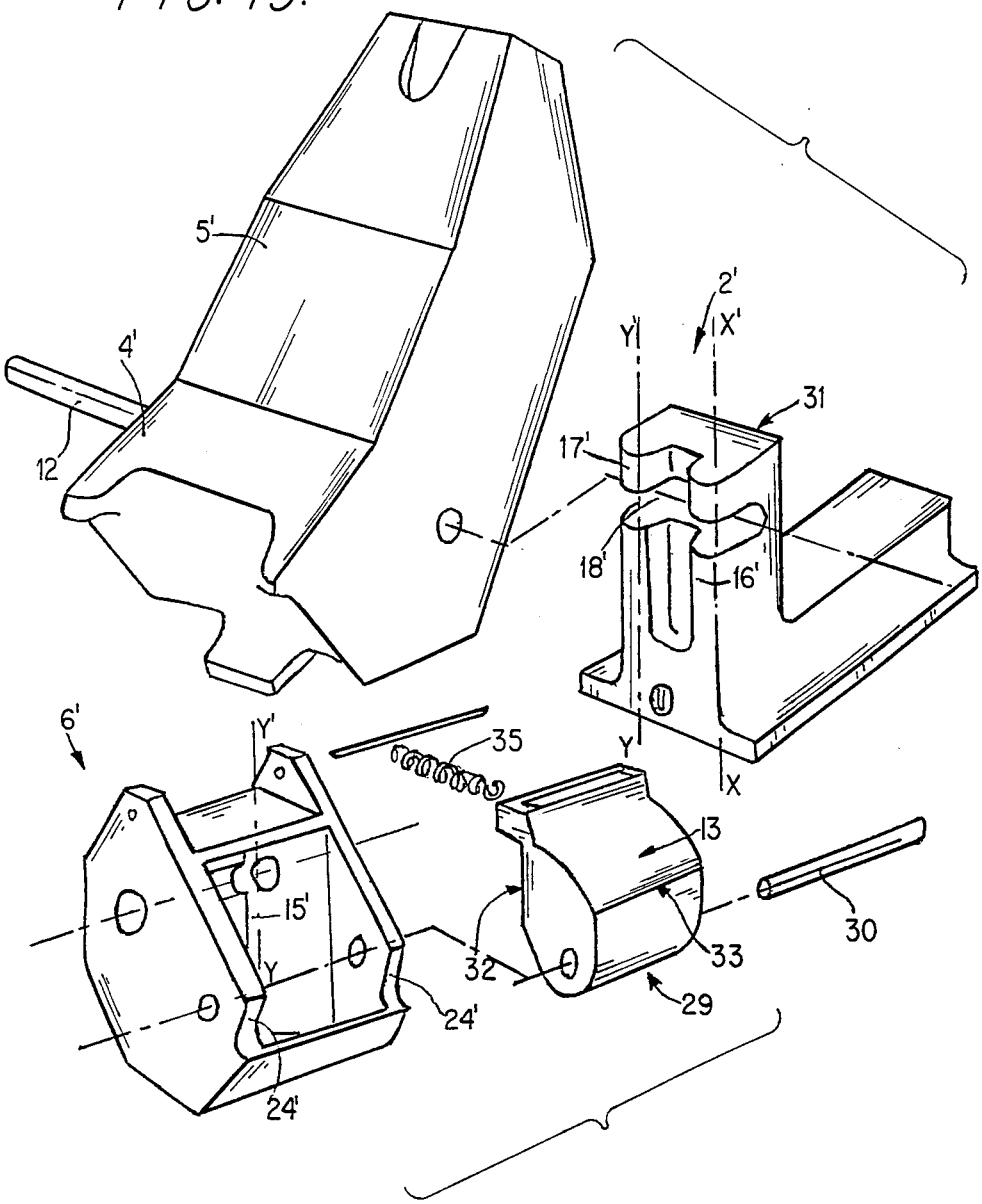
Figure 14:
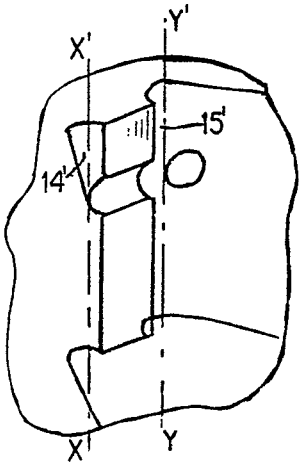

FIG. 6 shows one of the positions of assembly 1 during a lateral pivoting of assembly 1 in the direction $P_2$. As seen in FIG. 6 movable assembly 1 pivots around axis YY' which is contrary to the bias of elastic system 7. The lateral movement of the assembly and consequently the lateral release of the boot is a function of $F_1$ multiplied by $l_{1'}$, the lever arm, or the perpendicular distance between a line in the direction of $F_1$ and YY'. If the forces acting on assembly are such that the lateral pivoting occurs in the direction of $P_3$ (FIG. 6), then pivoting occurs around axis XX'.

It is, of course, possible for vertical forces acting on assembly 1 during skiing to be combined with lateral forces acting on the binding. Thus, the jaw would pivot in a way that would combine directions $P_1$ and $P_2$. In other words, assembly 1 would pivot vertically and laterally simultaneously. As has already been stated, release incline 13 has the general shape of a trapezoid so that when assembly 1 pivots laterally and vertically, the lateral release retention moment is decreased. FIGS. 7 and 8 show how, with such an arrangement, this effect occurs. FIG. 7 shows a lateral pivoting of assembly 1 which is not combined with a vertical pivoting. Piston 8 acts on incline 13 at point A on edge 25 and the value of the resistance offered by elastic system 7 to lateral pivoting (or the release retention moment) is a function of $F_1$ multiplied by $l_1$.

FIG. 8 shows a lateral pivoting of assembly 1 combined with a vertical pivoting. The piston's point of contact with vertical release incline 13 is moved from point A to point B. The point of contact is thus brought closer to a line passing through XX' and parallel to $F_1$, thereby reducing the lever arm.

The value of the release retention moment which resists pivoting of assembly 1 away from its centered boot retaining position is a function of $F_3$ multiplied by $l_3$. The spring is compressed when assembly 1 pivots vertically, but due to the stiffness of the spring, $F_3$ has only a slightly greater value than $F_1$. On the other hand, $l_3$ is considerably less than $l_1$. As a result, $F_1$ multiplied by $l_1$ is greater than $F_3$ multiplied by $l_3$. Thus, the value of the lateral release retention moment produced by elastic system 7 to resist lateral pivoting of assembly 1 is less when it is combined with a vertical pivoting of assembly than when lateral pivoting occurs alone. It should be noted that in the embodiment shown in FIGS. 1–8, support lines XX' and YY' are located parallel to each other, but they can be placed in other relationships to each other. For example, support lines can also converge upwards and intersect at a point C (FIG. 9) above the ski.

FIG. 9 represents a simplified illustration of support element 2' and the corresponding pivoting element 6'. Grooves 14 and 15 converge, as do the projections 16 and 17. Groove 14 and projection 16 form between them support line XX'. Groove 15 and projection 17 form between them support line YY'. Support lines XX' and YY' as seen in the embodiment in FIG. 9 converge at a point above the ski. Groove 18 of the support element 2' is a vertical retaining groove for retaining pivot 6 against vertical movement and comprises two sloped section or complementary vertical retaining grooves 180 and 181 whose longitudinal axes are perpendicular to the XX' and YY' support lines, respectively. The same is true for the corresponding projection 19 of the pivoting element 6', which is a vertical retaining projection and which has two converging projections 190 and 191, or vertical retention projections whose longitudinal axes are perpendicular to the XX' and YY' lines, respectively. The grooves and projections are preferably at least partially cylindrical and therefore their cross-section is in the shape of at least a part of a circle, although as can be seen in FIG. 10, they can be of other shapes such as triangular. To improve elastic system 7's point of contact with incline 13, a pivoting transverse pin 28 is positioned between piston 8 and release incline 13 as seen in FIG. 1.

FIGS. 11–24 and 28–29 illustrate an embodiment of the invention wherein vertical release incline 13 is located on a rocker 29 journalled on pivoting element 6. Such a binding, a non-limiting example of which is shown in FIG. 11, comprises an assembly 1' which is adapted to move in relation to a support element 2' which is attached to the ski 3'. Movable assembly 1' includes a jaw 4' attached to a body 5' and a pivoting element 6'. In the embodiment described in FIGS. 11–16, body 5' is a single unit and is integral with jaw 4'. However, other embodiments may be used, wherein body 5' is not integral with jaw 4, as seen in FIGS. 25–27 and 33–36. Preferably, body 5' extends rearwardly and upwardly from jaw 4'. Body 5' comprises and houses an elastic system 7' which includes a piston 8' biased by a spring 9 which rests on the adjustment plug 10.

On the back of jaw 4' and attached to body 5 is a housing 11' into which support element 2' extends and in which pivoting element 6' is also positioned. Pivoting element 6' is laterally placed in housing 11' and held therein by axis pin 12. Jaw 4' pivots in relation to pivoting element 6' around a transverse and horizontal axis transverse to said binding and/or ski and passing through axis pin 12. Thus, jaw 4' is adapted to pivot vertically in the direction of $P_1$, for example. This pivoting is done against the action of the elastic system 7' which exerts a vertical release retention force F on vertical release incline 13.

Assembly 1 and pivoting element 6' are also adapted to pivot laterally around either one of two lines of support located on either side of the longitudinal plane of symmetry of the ski and/or binding. This is achieved as follows. Pivoting element 6' is adapted to contact or engage support 2'. Contact between these two elements is guaranteed by elastic system 7' which is adapted to biases these elements into contact with one another. Support 2' and pivot 6' comprise a lateral pivoting system. This system includes two lines of support XX' and YY' symmetrically located on either side of the longitudinal plane of symmetry of the ski and/or binding, around which pivot 6' laterally pivots against the bias of elastic system 7. This bias exerted by elastic system 7' to resist the lateral pivoting of assembly 1 is called the lateral release retention force. The lines of support may be parallel to each other or converge at a point above the ski.

To form these support lines, projections are formed on one of the elements (either pivot 6' or support 2') and corresponding or complementary grooves were formed on the other element (e.g., on pivot 6' if the projections were formed on support 2', or on support 2' if the projections were formed on pivot 6'). In the embodiment given by way of a non-limiting example in FIGS. 11–24, grooves 14' and 15' are seen on the rear of pivoting element 6' and projections 16' and 17' are found on the front of the support element 2'. The cooperation of groove 14' with projection 16' defines support line XX' and the cooperation of groove 15' with projection 17' defines support line YY'. The vertical retention of pivoting element 6' is assured because axis pin 12 is engaged in a housing 18' on support element 2'.

The rear of pivoting element 6' has an opening therein for receiving axis pin 30. A rocker 29 is journalled on pivot 6' by also passing axis pin 30 through an opening in rocker 29 so that rocker 29 may pivot vertically with respect to pivot 6 around an axis transverse to the binding and/or ski and passing through axis pin 30. The upper rear portion of rocker 29 has a vertical release incline 13 thereon. In addition, the back portion of support 2' has an incline 31 thereon designed to assist in the lateral release of the boot as will be described below, and against which the front flat side or portion 32 of rocker 29 is biased. In the centered retention position shown in FIG. 11, piston 8' is biased by spring 9 into contact with incline 13, thereby forcing the front flat side 32 of rocker 29 against the back flat portion or side of 31 of support element 2'. In this embodiment incline 13 is above a horizontal plane passing through the axis around which rocker 29 pivots.

When pivot 6' pivots vertically in the direction $P_1$, nose 34 of piston 8' travels downwardly along incline 13. Because incline 13 extends rearwardly and downwardly away from the front portion of rocker 29, incline 13 compresses elastic system 7' and piston 8'. Thus incline 13 acts as a compressing element. Once nose 34 of piston 8' passes release nose 33 of rocker 29, the boot is released from the boot and nose 34 of piston 8' contacts the opening incline 24' located at the back or rear portion of pivoting element 6'. Because opening incline 24 extends forwardly and downwardly toward the front of pivot 6' incline 24 allows elastic system 7' to expand. In other words, incline 24 is decompressive for elastic system 7. Because incline 24 is decompressive of elastic system 7' , the complete opening of jaw 4' is guaranteed and jaw 4' is held in its open position after release of the boot is effected. The binding is now ready to receive another boot.

FIGS. 11 and 12 shows the binding in its centered retention position. The action of incline 13 on the piston 8' and thus on the movable assembly 1' is a force F' which holds jaw 4' in its vertical retention position and also guarantees that pivoting element 6' will be forced against support element 2'.

FIG. 15 shows assembly 1' and jaw 4' moved out of its centered retaining position due to either a vertical safety release of the boot during skiing, caused by the heel 26 of the boot pivoting assembly 1 vertically or due to a voluntary release of the boot using, for example, a rod 27 on the upper end of body 5', which serves as the lever to aid in the removal of the boot. Vertical pivoting of assembly 1' and vertical release of the boot is a function of the vertical release retention moment, which is the vertical release retention force $F'_1$ multiplied by d, the lever arm, both of which are shown in FIG. 15.

FIG. 16 shows one of the positions of assembly 1 during a lateral pivoting of assembly 1 in the direction $P_2$. Movable assembly 1' pivots around axis YY' against the bias of elastic system 7'. Lateral release of the boot and lateral pivoting assembly is a function of the lateral release retention moment which is a function of the lateral release retention force $T_1$ of the support on the rocker, multiplied by the lever arm l. If the forces acting on the binding are such that assembly 1 laterally pivots in direction $P_3$, (FIG. 16), the rotation occurs around axis XX'.

It is within the scope of the invention for the grooves on pivoting element 6' to be replaced by projections as on pivot 6 in FIGS. 1–8, and the projections on support 2' can be replaced by grooves as on support 2 in FIGS. 1–8; the grooves and projections are interchangeable. Moreover, as in FIGS. 11–16, support lines XX' and YY' are parallel to one another but this too may be varied while remaining within the scope of the invention. Thus, the support lines may converge toward the top of support 2' and pivot 6' and intersect at a point C above the ski as is shown in FIG. 9.

FIG. 17 is a partial view of a longitudinal cross-section of assembly 1 showing the binding in a position in which it can receive a boot. Piston 8' is no longer in contact with rocker 29. To ensure that rocker 29 continues to contact support element 2, a spring 35 is provided. The presence of this spring is necessary to ensure the continued centered position of jaw 4' when a boot attached to the binding, by forcing the front side 32 of the lever 29 into contact with the back side 31 of the support element 2'. Thus, spring 35 comprises a locking system for locking the binding in its centered position where the boot is placed therein. The structure of the binding may be altered, as in FIGS. 18–20, 23 and 24, which will be discussed below, to reduce the reliance on spring 35 for maintaining contact between rocker 29 and support 2. In these embodiments, the spring chosen to be spring 35 need only exert a small force, or spring 35 may be eliminated entirely.

As seen in FIGS. 18, 19 and 20, piston 8'' includes a nose 34 which contacts and moves across rocker 29 during the vertical pivoting and release of the boot. Piston 8'' also includes a centered section having a projection 36 which comprises the locking system and is adapted to cooperate with rocker 29 so as to bias rocker 29 against support element 2 (FIG. 19) and ensure that the assembly and jaw will be retained in their centered position when a boot is attached to the binding without using spring 35.

It is evident that a vertical pivoting by the jaw in the direction $P_1$ can be combined with a lateral pivoting in the direction $P_2$ or $P_3$. When this occurs, due to the structure of the assembly and the position of the locking system the lateral release retention moment of the elastic system is reduced when compared to the release retention moment in the case of a pure lateral pivoting and/or release of the boot. This reduction is necessary for the satisfactory release of the boot and will be explained using schematic FIGS. 21 and 22.

FIG. 21 shows a lateral pivoting of the binding that is not combined with a vertical pivoting. The point of contact of the piston on the vertical release incline 13 is located at point A. The force T' of the support element 2' on rocker 29 guarantees that the centered position is biased against lateral pivoting; the effect of force T' is such that, its absolute value is: $T'=F'e_1/e_2$, where $e_1$ is the distance from a line in the direction of $F_1$ to a line passing through pin 30 and parallel to the direction of $F_1$, and $e_2$ is the distance from a line in the direction of T' to a line passing through pin 30 and parallel to the direction of T'.

FIG. 22 shows a lateral pivoting of the jaw combined with a vertical pivoting of the jaw. The point of contact between the piston and the vertical release incline 13 has now moved from point A to point B. Force $F'_3$, the force of rocker 29 on the piston, which is substantially equal to F', has in relation to the axis around which rocker 29 pivots, a lever arm $e_3$ which is much smaller than $e_1$. $e_3$ is the distance from a line in the direction of T'3 to a line parallel to T'3 and passing through pin 30. Under these conditions, $T'_3$, which defines the lateral retention release force, is equal, in absolute value, to $F'_3$ $e_3/e_2$; thus $T'_3$ is much less than T'. Because the value of a lateral release retention moment is a function of T' l' in the case of a pure lateral pivoting and a function of $T'_3$ l, when there is a vertical pivoting at the same time, the lateral release retention moment is reduced when a lateral and vertical pivoting occur simultaneously, as compared to a lateral pivoting alone.

FIG. 23 shows another embodiment of the locking system wherein axis pin 30 of lever 29' is positioned below its location in FIGS. 17–19 so that elastic system 7', when it is in the position when there is no boot present (shown by the dotted line), acts positively on rocker 29' to assure that force T maintains jaw 4' in its centered retention position without the need for an auxiliary spring 35. The nose of piston 8' is constantly in contact with rocker 29', regardless of the position of the jaw and produces a force F against rocker 29'.

FIG. 24 illustrates an embodiment wherein lever or rocker 29'' is journalled on pivoting element 6'' around axis pin 30 located on the upper section of pivoting element 6'. The lower section of rocker 29'' comprises an activation element 32' biased against side 31 of support 2 to maintain the lateral position of the jaw. In this embodiment incline 13 is located below a horizontal plane passing through axis pin 30.

Figure 25:
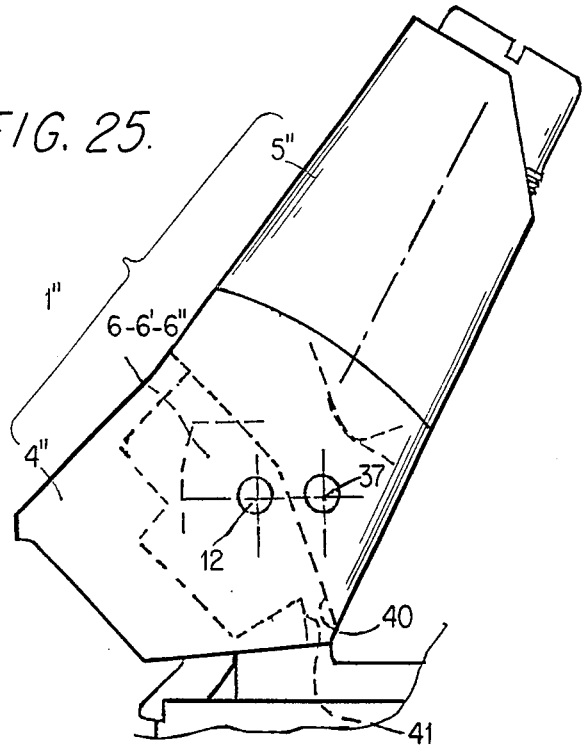
Figure 26:
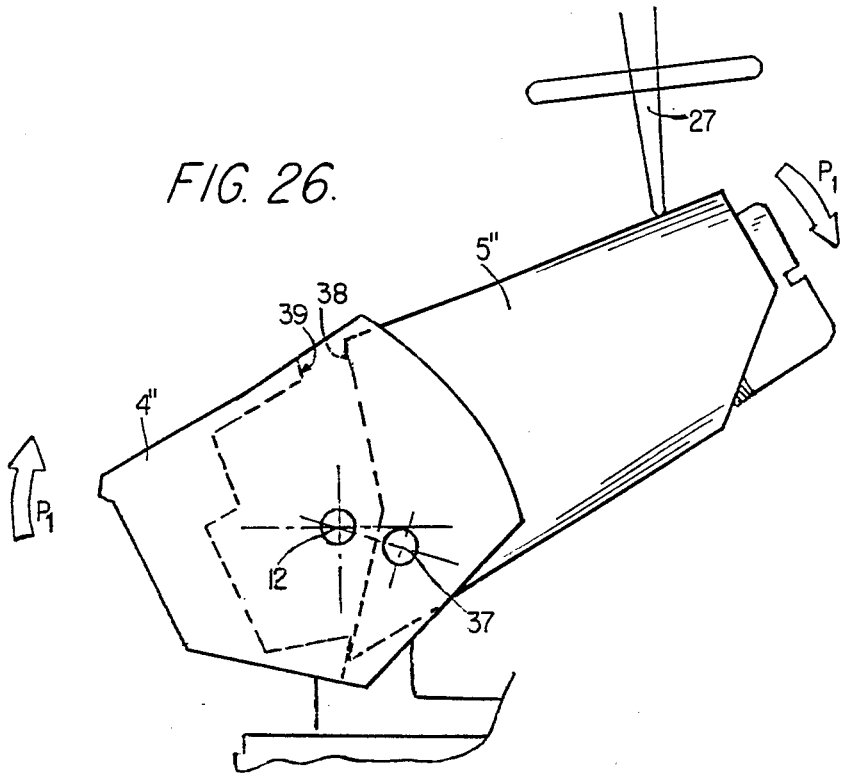
Figure 27:
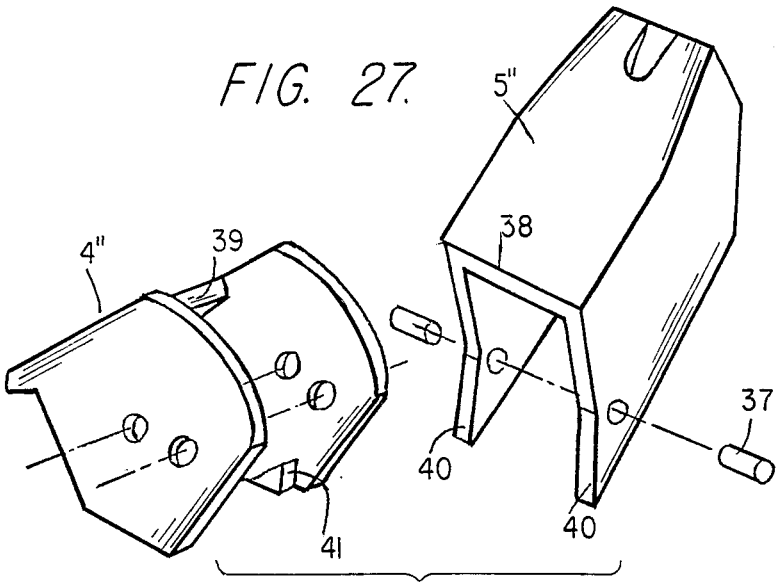

In the preceding embodiments, body 5 or 5' comprised an extension in the form of a jaw integral with body 5 or 5'. A body 5'' which extends behind jaw 4'' but which is not integral therewith, is shown in FIGS. 25, 26 and 27. In effect, body 5'' is journalled on jaw 4'' around transverse axis pin 37. In addition, a stop system 38–39 and 40–41 is provided to permit the body and the jaw to cooperate so that the boot may be more easily removed from the binding by the skier and so that the boot may be replaced in the binding automatically.

FIG. 25 illustrates the binding in a locked position for the retention of the boot. Top stop 38 of body 5'' contacts top stop 39 of jaw 4''; during a vertical safety release of the boot, jaw 4'' carries body 5'' therewith in the direction $P_1$. Voluntary manual release of the boot, on the other hand, occurs in two phases. In the first phase, body 5'' pivots in the direction $P_1$ around axis pin 37 until bottom stop 40 on body 5'' comes into contact with bottom stop 41 on jaw 4''. During the second phase, body 5'' rotates jaw 4'' as may be seen in FIG. 26.

Figure 28:
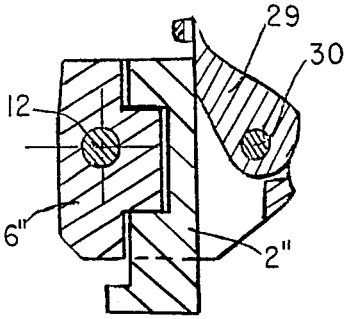

The vertical retention of the jaw may be effected by axial pin 12, as shown in FIGS. 11–19. In addition, the jaw may be vertically retained, in a completely different manner by axial pin 12 located in pivoting element 6 which is vertically retained by support 2. FIG. 28 shows a jaw assembly having a rocker 29 as in FIGS. 11–19, but being vertically retained by a pin 12 engaging pivot 6 which is vertically retained in relation to support 2, as seen in FIGS. 1–8.

Figure 29:
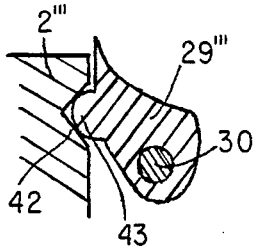

To guarantee lateral pivoting and release of the boot, cooperation between rocker 29 and support element 2 can take many forms. The embodiments illustrated in FIGS. 1–28 are an example of this cooperation. In FIG. 29, an alternative embodiment is illustrated wherein a projection 43 on rocker 29''' cooperates with a groove 42 in support 2'''.

Figure 30:
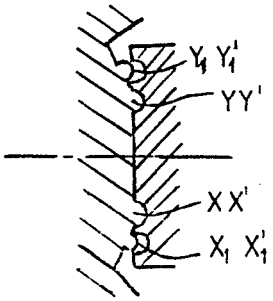

It is also within the scope of the invention to have two pairs of support lines $XX'-X_1X'_1$ and $YY'-Y_1Y'_1$ each pair of which is symmetrically located on either side of the longitudinal plane of symmetry of the ski and/or binding as is illustrated in the schematic drawing in FIG. 30.

FIG. 31 shown an alternate embodiment of a voluntary release binding. A lever 44 is provided for removing the boot. Lever 44 is journalled on body 5''' around an axis pin 45. Lever YY comprises a cross piece 46 connected to piston 8. A slot 47 is provided in the lateral walls of body 5''' so that the crosspiece can move therein. The movement of lever 44 in the direction $P_1$ causes the piston to retract in the direction $P_4$.

FIG. 32 shows an alternative embodiment of the elastic system, wherein the mobile member is a lever 8''' journalled on the body around axis pin 48 and biased by a spring 9.

It should be noted that the bindings described hereinabove may be used in combination with all types of bindings intended to grip either end of the boot or any other part of the boot.

FIGS. 33–36 show another alternative embodiment of the binding, wherein body 5'''' is not journalled on the jaw as in the embodiments illustrated in FIGS. 25 and 26. Rather, body 5'''' is journalled on the pivoting element 6''' around axis pin 37'. All like elements used in the other embodiments are also found here, in this embodiment. These elements have the same reference numbers; however, these reference numbers are distinguished from other embodiments by adding apostrophe's at the end thereof (for example, 4', 4'', 4''', . . . ). Body 5'''' has two stop systems on its bottom. Bottom stops 40' and lower stops 50 comprise one system and upper stops 53 comprise the other stop system. In addition, the lower section of the lateral walls of body 5'''' comprises another incline system 54. Pivoting element 6''' has two pairs of stops, bottom stops 51 and upper stops 52, and there are two projections 55 and two stops 41' inside jaw 4''''. The position of body 5'''' (FIG. 33) is determined by the cooperation of the body's stops 53 with stops 51 of pivot 6'''' when the boot is in place. Voluntary release of the boot occurs, as described previously, by the pivoting of the body 5'''' in the direction $P_1$ around an axis pin 37' in two phases. First, incline 34 in cooperation with projection 55 forces jaw 4'''' to pivot upwards (FIG. 34). Next body stop 40' comes into contact with stop 41' located in jaw 4''''. Thus the bottom section of the body, by the engaging of stops 40' and 41', forces the jaw to pivot upwards. The pivoting of the body 5'''' in the direction $P_1$ is halted when stop 50 contacts stop 52 of pivoting element 6''' (FIG. 35).

During the first phase of the voluntary removal of the boot, the angle B through which body 5'''' moves is greater than the angle a through which the jaw 4'''' moves (FIG. 34). Consequently, the force necessary for removing the boot is smaller than the force required to remove a boot attached to a binding having a jaw that is integral with the lever. During the second phase, and given the position of the jaw and body, the angle $\alpha_1$ is at least equal to $\beta_1$. Thus, a small rotation of the body at the end of the binding causes a large rotation of the jaw at the other end of the binding to its open position so that the jaw is in a good position for reinsertion of the boot.

It should be noted that it is within the scope of the invention to include an embodiment having a stop to prevent purely lateral releases such as for example, the one described in French Pat. No. 72.17049, which is hereby incorporated by reference.

Although the invention has been described with respect to particular means and embodiments, it is to be understood that the invention is not limited to the particulars disclosed and extends to all equivalents falling within the scope of the claims.

What is claimed is:

1. A safety binding for securing a boot to a ski comprising:

(a) a support, having a rear portion, attached to said ski; and (b) an assembly, comprising:

(i) a jaw;

(ii) a pivoting element;

(iii) an elastic means contacting the rear portion of said support for biasing said support and said pivoting element into contact with each other, wherein at least a portion of said assembly is adapted to pivot vertically and laterally against the bias of said elastic means and wherein said lateral pivoting is performed about either of two lines of support located symmetrically on either side of the longitudinal plane of said binding, wherein said two lines of support are positioned between said pivoting element and said support, and wherein the interaction of said rear portion of said support and said elastic system produces a lateral release retention moment at a given lateral position of said assembly which opposes the lateral pivoting of said assembly wherein said support further includes a reduction means for reducing the lateral release retention moment when said assembly pivots laterally and vertically as compared to when said assembly pivots laterally.

2. The binding of claim 1 wherein said elastic means biases said assembly to a centered retention position.

3. The binding of claim 1 wherein said assembly further includes a body, attached to said jaw and extending rearwardly and upwardly therefrom, wherein said elastic system is housed in said body.

4. The binding of claim 3 wherein said jaw is journalled on said pivoting element so as to be adapted to pivot vertically around an axis transverse to the longitudinal axis of said binding.

5. The binding of claim 4 wherein said pivoting element is adapted to pivot laterally around either of said two lines of support against the bias of said elastic system.

6. The binding of claim 1 wherein said support has a front portion and said pivoting element contacts the front portion of said support.

7. The binding of claim 6 wherein said front portion of said support and said pivoting element comprise a lateral pivoting system, wherein said lateral pivoting system comprises two projections and two complementary grooves and wherein each line of support is defined by the cooperation between one of said projections and one of said complementary grooves.

8. The binding of claim 7 wherein said lines of support are parallel to one another.

9. The binding of claim 7 wherein said lines of support converge at a point above said ski.

10. The binding of claim 7 wherein the front portion of said support comprises said two projections and said pivoting element comprises said two complementary grooves.

11. The binding of claim 7 wherein the front portion of said support comprises said two complementary grooves and said pivoting element comprises said two projections.

12. The binding of claim 7 wherein said support further includes a vertical retention groove having beveled ends, and wherein said pivoting element further includes a vertical retention projection adapted to engage said vertical retention groove.

13. The binding of claim 7 wherein said rear portion of said support comprises: a release incline extending rearwardly and downwardly from the front portion of said support, and an opening incline, extending downwardly and forwardly from said release incline.

14. The binding of claim 7 wherein said elastic means is adapted to pivot vertically and laterally, and wherein said support comprises a compressing means for compressing said elastic means when said elastic means pivots vertically away from a centered boot retaining position.

15. The binding of claim 14 wherein said compressing means comprises a release incline extending downwardly and rearwardly from the front portion of the support.

16. The binding of claim 14 wherein said assembly further includes a body, attached to said jaw, wherein said elastic system is housed on said body and wherein said jaw is in an open position when said boot is released, and wherein said support further comprises a decompressing means for decompressing said elastic means after said elastic means has been compressed by said compressing means and said boot has been released from said jaw, wherein said decompressing means holds said jaw in its open position after the boot is released.

17. The binding of claim 16 wherein said decompressing means comprises an opening incline extending downwardly and forwardly from said release incline.

18. The binding of claim 7 wherein the rear portion of said support comprises a release incline in the shape of a trapezoid whose two lateral edges converge downward.

19. The binding of claim 1 wherein said reduction means comprises a release incline in the shape of a trapezoid whose two lateral edges converge downward.

20. The binding of claim 9 wherein said pivoting element comprises said two projections and further includes two vertical retaining projections, the longitudinal axis of each of said two vertical retaining projections being perpendicular to a different support line, and wherein said support further includes said two complementary grooves and two complementary vertical retaining grooves, the longitudinal axis of each of said vertical retaining grooves being perpendicular to a different one of said support lines.

21. The binding of 7 wherein said grooves and projections have a cross-section in the shape of at least part of a circle.

22. The binding of claim 7 wherein said grooves and projections have a triangular cross-section.

23. The binding of claim 7 wherein said assembly further includes a body integral with said jaw, wherein said elastic system is housed in said body.

24. The binding of claim 1 wherein said pivoting element further includes a rocker journalled on said pivoting element, wherein said elastic means is adapted to contact said rocker.

25. The binding of claim 24 wherein said support has a front portion and rear portion and said rocker has a front portion, wherein said pivoting element contacts the front portion of said support and the front portion of said rocker is adapted to contact the rear portion of said support.

26. The binding of claim 25 wherein the front portion of said support and said pivoting element comprise a lateral pivoting system, wherein said lateral pivoting system comprises two projections and two complementary grooves and wherein each line of support is defined by the engagement between one of said projections and one of said complementary grooves.

27. The binding of claim 26 wherein said lines of support are parallel to each other.

28. The binding to claim 26 wherein said lines of support converge at a point above the ski.

29. The binding of claim 26, wherein the front portion of said support comprises two projections and said pivoting element comprises two complementary grooves.

30. The binding of claim 26 wherein the pivoting element comprises two projections and wherein the front portion of said support comprises two complementary grooves.

31. The binding of claim 26 further including vertical retention means for retaining the vertical position of said pivoting means in relation to said support.

32. The binding of claim 26 wherein said rocker has a rear portion adapted to contact such elastic means.

33. The binding of claim 32 wherein the rear portion of said rocker comprises a release incline, extending rearwardly and downwardly from the front portion of said rocker.

34. The binding of claim 32 wherein said elastic means is adapted to pivot vertically and wherein said rocker comprises a compressive means for compressing said elastic means when said elastic means pivots vertically away from a centered boot retaining position.

35. The binding of claim 34 wherein said compressing means is a release incline extending rearwardly and downwardly from the front portion of said rocker.

36. The binding of claim 35 wherein said rocker further includes a release nose, on the end of said release incline, wherein, when said elastic means contacts said nose, the boot is released.

37. The binding of claim 36 wherein said pivoting element further includes a decompressive means for decompressing said elastic means, and positioned so that said elastic means contacts said opening incline when pivoting vertically passed said release nose.

38. The binding of claim 37 wherein said decompressive means is an opening incline, extending downwardly and forwardly from said front portion of said pivoting element.

39. The binding of claim 38 further including a locking means for locking said assembly in a centered boot retaining position when said boot is attached to said jaw when said assembly in an open position.

40. The binding of claim 39 wherein said locking means comprises a spring for biasing said rocker into contact with said support.

41. The binding of claim 39 wherein said locking system comprises a projection on said elastic means, wherein said projection biases said rocker against said support when said elastic means contacts said opening incline.

42. The binding of claim 39 wherein said locking system comprises an axis pin attaching said rocker to said pivoting element and around which said rocker pivots around said pivoting element, wherein said pin is so positioned that said elastic means biases said rocker against said support when said assembly is in its open position.

43. The binding of claim 32 wherein the interaction of said rocker and said elastic means produces a lateral release retention moment at a given lateral position of said assembly which opposes the lateral pivoting of said assembly, wherein said rocker constitutes said reduction means for reducing the lateral release retention moment at a given lateral position when said assembly pivots laterally and vertically as compared to when said assembly pivots laterally.

44. The binding of claim 43 wherein said reduction means includes a release incline extending rearwardly and downwardly from the front portion of said rocker.

45. The binding of claim 33, wherein said rocker pivots around an axis and wherein said incline is positioned above a horizontal plane passing through said axis.

46. The binding of claim 33 wherein said rocker pivots around an axis and wherein said incline is positioned beneath a horizontal plane passing through said axis.

47. The binding of claim 32 further including a body housing said elastic means, wherein said jaw is integral with said body.

48. The binding of claim 1 further including a body housing said elastic means and within which said pivoting element pivots, wherein said body is journalled on said jaw around an axis transverse to the longitudinal axis of said binding.

49. The binding of claim 48 wherein said body includes a top stop and bottom stop and said jaw includes a top stop and bottom stop wherein said stops are so positioned that when said assembly is in its centered boot retaining position, said bottom stops of said body and jaw are spaced apart to permit vertical pivoting of said body with respect to said jaw toward the open position of said binding.

50. The binding of claim 49 wherein said top stops are so positioned that they contact each other where the assembly is in its centered boot retaining position.

51. The binding of claim 32 wherein said rocker has a projection thereon for mating with a recess in said support.

52. The binding of claim 32 wherein said lateral release system includes two pairs of projections and two pairs of grooves, each pair symmetrically located on either side of a longitudinal plane of symmetry of said binding.

53. The binding of claim 32 wherein said elastic means includes a piston and spring wherein said assembly further includes a body housing said elastic means, wherein said body includes a lever means, journalled on said boot for retracting said piston.

54. The binding of claim 32 wherein said elastic means includes a mobile member and spring and said assembly further includes a body housing said elastic means, wherein said mobile member is a lever journalled on said body.

55. The binding of claim 31 wherein said assembly further includes a body, housing said elastic means wherein said body is journalled on said pivoting element.

56. The binding of claim 55 wherein said body includes an incline and said jaw comprises at least one projection wherein said projection of said jaw and said incline of said body are so positioned that said projection engages said incline to pivot said jaw upward, when said body is rotated in one direction away from said centered boot retaining position.

57. The binding of claim 56 wherein said body includes at least one bottom stop and said jaw includes at least one stop wherein said bottom stop are so positioned as to contact each other after said projection contacts said incline as said assembly pivots away from said centered boot retaining position.

58. The binding of claim 47 wherein said body further includes at least one lower stop and said pivoting element includes at least one bottom stop, wherein said lower stop of said body and said bottom stop of said pivoting element are so positioned that they contact each other and prevent further upward pivoting of said assembly at some point after said assembly has pivoted upward to an open position wherein said boot is released.

59. The binding of claim 57 wherein the angle through which said body pivots before said bottom stop of said jaw and body contacts said stop of said jaw is greater than the angle through which said jaw pivots.

60. The binding of claim 58 wherein after said bottom stop of said body contacts said stop of said jaw, as said assembly pivots, the angle through which said jaw pivots is at least as great as the angle through which said body pivots.

61. The binding defined by claim 1 wherein said pivoting element contacts only the front of said support, wherein said elastic means produces a force on the rear of said support.

* * * * *

UNITED STATES PATENT AND TRADEMARK OFFICE

CERTIFICATE OF CORRECTION

PATENT NO. : 4,753,452

DATED : June 28, 1988

INVENTOR(S) : Jean-Pierre BOUSSEMART et al.

It is certified that error appears in the above-identified patent and that said Letters Patent is hereby corrected as shown below:

At column 1, line 47, change "positio" to ---position---.

At column 2, line 57, change "portoin" to ---portion---.

At column 4, line 30, change "passed" to ---past---.

At column 4, line 55, change "land" to ---and---.

At column 5, line 47, delete "so" (second occurrence).

At column 5, line 63, change "illustrates" to ---illustrate---.

At column 7, line 4, insert ---of--- after "view".

At column 7, line 5, delete "of" (second occurrence).

At column 8, line 23, insert ---,--- after "3".

At column 9, line 21, insert ---,--- after "6".

At column 9, line 22, insert ---,--- after "YY'".

At column 9, line 25, change "$l_1$' " to ---$l_1$ ---

At column 10, line 25, insert ---,--- after "shapes".

At column 10, line 33, insert ---,--- after "1'".

At column 10, line 34, insert ---,--- after "2'".

At column 10, line 43, insert ---,--- after " 7' "

UNITED STATES PATENT AND TRADEMARK OFFICE

CERTIFICATE OF CORRECTION

PATENT NO. : 4,753,452

DATED : June 28, 1988

INVENTOR(S) : Jean-Pierre BOUSSEMART et al.

It is certified that error appears in the above-identified patent and that said Letters Patent is hereby corrected as shown below:

At column 10, line 65, change "biases" to ---bias---.

At column 11, line 33, insert ---,--- after "embodiment".

At column 11, line 52, insert ---,--- after "6 .

At column 11, line 55, change "7' ," to ---7',---.

At column 11, line 59, change "shows" to ---show---.

At column 12, line 18, delete "," after "$P_3$ ".

At column 13, line 7, delete "," after "that".

At column 13, lines 26 and 27, change "$T_3$ '1," to ---$T_3$ '1'---.

At column 14, line 23, change "shown" to ---shows---.

At column 14, line 26, change "YY" to ---44---.

At column 15, line 2, change "B" to ---β---.

At column 15, line 3, change "a" to ---α---.

At column 15, line 16, insert ---,--- after "as".

At column 17, line 32, change "to" to ---of---.

At column 18, line 6, insert ---is--- after "assembly".

At column 19, line 11, change "31" to ---1---.

UNITED STATES PATENT AND TRADEMARK OFFICE

CERTIFICATE OF CORRECTION

PATENT NO. : 4,753,452

DATED : June 28, 1988

INVENTOR(S) : Jean-Pierre Boussemart, et al

It is certified that error appears in the above-identified patent and that said Letters Patent is hereby corrected as shown below:

Column 20, line 3, change "47" to --57--

Signed and Sealed this

Seventh Day of May, 1991

*Attest:*

*Attesting Officer*

HARRY F. MANBECK, JR.

*Commissioner of Patents and Trademarks*